US008308094B2

(12) United States Patent
Hoice et al.

(10) Patent No.: US 8,308,094 B2
(45) Date of Patent: Nov. 13, 2012

(54) SHREDDER HAMMERS INCLUDING IMPROVED ENGAGEMENT BETWEEN THE HAMMER PIN AND THE HAMMER

(75) Inventors: John P. Hoice, Vancouver, WA (US); Lonny V. Morgan, Battle Ground, WA (US); Daniel R. Morrow, Portland, OR (US); David M. Graf, Scappoose, OR (US); Terry L. Briscoe, Portland, OR (US)

(73) Assignee: ESCO Corp., Portland, OR (US)

( * ) Notice: Subject to any disclaimer, the term of this patent is extended or adjusted under 35 U.S.C. 154(b) by 257 days.

(21) Appl. No.: 12/713,825

(22) Filed: Feb. 26, 2010

(65) Prior Publication Data

US 2010/0213301 A1 Aug. 26, 2010

Related U.S. Application Data

(60) Provisional application No. 61/155,852, filed on Feb. 26, 2009.

(51) Int. Cl.
*B02C 13/28* (2006.01)

(52) U.S. Cl. ..... 241/194; 241/195

(58) Field of Classification Search ..... 241/194, 241/195, 73

See application file for complete search history.

(56) References Cited

U.S. PATENT DOCUMENTS

| | | | |
|---|---|---|---|
| 1,940,116 | A | 12/1933 | Brooks |
| 2,534,301 | A | 12/1950 | Sennholtz |
| 2,716,526 | A | 8/1955 | Baker |
| 2,750,124 | A | 6/1956 | Brown |
| 2,678,794 | A | 10/1956 | Putnam |
| 3,236,463 | A | 2/1966 | Ratkowski |
| 3,738,586 | A | 6/1973 | Fabert, Jr. |
| 3,844,494 | A | 10/1974 | Hightower |
| 4,141,512 | A | 2/1979 | Francis |
| 4,142,687 | A | 3/1979 | Potwin |
| 4,310,125 | A | 1/1982 | Novotny |

(Continued)

FOREIGN PATENT DOCUMENTS

| | | | |
|---|---|---|---|
| EP | 0240440 | A2 | 10/1987 |

(Continued)

OTHER PUBLICATIONS

International Search Report and Written Opinion in corresponding PCT Application, International Application No. PCT/US2010/025508 mailed Apr. 20, 2010.

*Primary Examiner* — Faye Francis
(74) *Attorney, Agent, or Firm* — Banner + Witcoff, Ltd.

(57) ABSTRACT

Shredder hammers include a hammer pin opening in which at least some portion of the interior surface is curved in a direction moving from one major surface of the shredder hammer to the other. This interior surface may be smoothly formed as an arc of a circle, as a parabola, as a hyperbola, or as another curved surface, with the local extrema within the interior of the hole (e.g., at or near the center). Providing the curved interior surface helps vary and disperse the locations where force is absorbed due to contact between the hammer pin and the walls defining the hammer pin opening when the shredding hammer blade contacts the material to be shredded. Other structures include engagement between the hammer pin and the hammer as part of a bushing member, a spool or sleeve member, or a ball swivel member.

24 Claims, 27 Drawing Sheets

U.S. PATENT DOCUMENTS

| | | | | | |
|---|---|---|---|---|---|
| 4,558,826 | A | | 12/1985 | Martinek | |
| 4,805,842 | A | | 2/1989 | Vander Jagt | |
| 5,002,233 | A | | 3/1991 | Williams | |
| 5,073,038 | A | | 12/1991 | O'Connell | |
| 5,354,001 | A | * | 10/1994 | Hasegawa | 241/34 |
| 5,381,975 | A | | 1/1995 | Chon et al. | |
| 5,495,988 | A | * | 3/1996 | Follese et al. | 241/36 |
| D426,556 | S | | 6/2000 | Bradley et al. | |
| 6,523,766 | B1 | * | 2/2003 | Watt | 241/262 |
| 6,978,954 | B2 | * | 12/2005 | Kroger et al. | 241/36 |
| 7,416,144 | B2 | | 8/2008 | Kammerer et al. | |
| 7,419,109 | B1 | * | 9/2008 | Ronfeldt et al. | 241/189.1 |
| 7,757,979 | B2 | * | 7/2010 | Stelk | 241/25 |
| 7,823,816 | B2 | * | 11/2010 | Jensen | 241/36 |
| 2009/0250539 | A1 | | 10/2009 | Stelk | |

FOREIGN PATENT DOCUMENTS

| | | | | |
|---|---|---|---|---|
| GB | 2183504 | A | * | 6/1987 |
| JP | 2007283243 | A | | 11/2007 |

* cited by examiner

SHREDDER HAMMERS INCLUDING IMPROVED ENGAGEMENT BETWEEN THE HAMMER PIN AND THE HAMMER

RELATED APPLICATION DATA

This application claims priority benefits based on U.S. Provisional Patent Appln. No. 61/155,852, filed Feb. 26, 2009 in the names of John P. Hoice and Lonny V. Morgan and entitled "Shredder Hammers Including Improved Hammer Pin Opening Constructions." This earlier priority application is entirely incorporated herein by reference.

FIELD OF THE INVENTION

The present invention relates to shredder hammer constructions and to shredder machinery and systems including such hammers.

BACKGROUND

Industrial shredding equipment is known and used, for example, in the recycling industry to break apart large objects into smaller parts that can be more readily processed. In addition to shredding material like rubber (e.g., car tires), wood, and paper, commercial shredding systems are available that can shred large ferrous materials, such as scrap metal, automobiles, automobile body parts, and the like.

FIG. 1A illustrates an example shredding system as is known and in use in the art, and FIG. 1B illustrates a more detailed view of a conventional shredding head or rotors that may be used in such a shredding system. More specifically, as shown in FIG. 1A, this example shredding system 100 includes a material inlet system (such as chute 102) that introduces the material 104 to be shredded to the shredding chamber 106. The material 104 to be shredded may be of any desired size or shape, and, if desired, it may be heated, cooled, crushed, baled, or otherwise pretreated prior to introduction into the shredding chamber 106. If necessary or desired, the inlet system 102 may include feed rollers or other machinery to help push or control the rate at which the material 104 enters into the chamber 106, to help hold the material 104 against an anvil 108, and/or to help keep the material 104 from moving backward up the chute 102. A disc rotor is shown, however, other rotors, such as spider and barrel, are also commonly used, and this invention may be equally useful with those types of rotors.

A rotary shredding head 110 (rotatable about axis or shaft 110A) is mounted in the shredding chamber 106. As the head 110 rotates, the shredding hammers 112 extend outward and away from the rotational axis 110A of the head 110 due to centrifugal force (as shown in FIG. 1A, and as will be explained in more detail below). As they rotate, the shredder hammers 112 impact the material 104 to be shredded between the hammer 112 and the anvil 108 (or other hardened surface provided within the shredding system 100) in order to break apart the material 104. The construction of one conventional shredding head 110 will be described in more detail below in conjunction with FIG. 1B. As the material 104 is shredded, it may be discharged from the shredding chamber 106 through one of the outlets 114, e.g., provided in the bottom, top, or side of the chamber 106 walls, and transported in some manner (generally shown by arrows 116, such as via gravity, via conveyors, via truck or other vehicle, etc.) for further processing (e.g., further recycling, reclamation, separation, or other processing).

FIG. 1B provides a more detailed view of an example shredding head 110 that may be used in the shredding system 100 of FIG. 1A. This example shredding head 110 is made from multiple rotor disks 120 that are separated from one another by spacers 122 mounted around the drive shaft 110A. While any number of rotor disks 120 may be provided in a shredding head 110 (e.g., 2-25), this illustrated example includes seven disks 120 (the end disk 120 is omitted to better show the details of the underlying structures). The disks 120 may be fixedly mounted with respect to the shaft 110A (e.g., by welding, mechanical connectors, etc.) to allow the disks 120 to be rotated when the shaft 110A is rotated (e.g., by an external motor or other power source, not shown). In addition to providing a spacing function, spacers 122 can help protect the shaft 110A from undesired damage, e.g., due to contact with material 104 being shredded, broken parts of a shredder hammer 112, etc.

Hammer pins 124 extend between at least some of the rotor disks 120 (more commonly, between several disks 120 and/or through the entire length of the head 110), and the shredder hammers 112 are rotatably mounted on and are rotatable with respect to these pins 124. More specifically, as shown in FIG. 1B, a hammer pin 124 extends through an opening 112A provided in the mounting portion 112F of the shredder hammer 112, and the shredder hammer 112 is capable of rotating around this pin 124. In this illustrated example, the shredding head 110 includes six hammer pins 124 around the circumference of the rotor disks 120, and a single shredder hammer 112 is provided on each pin 124 between two adjacent rotor disks 120 (such that each hammer pin 124 includes a single shredder hammer 112 mounted thereon and such that the shredder hammers 112 are staggeringly distributed along the longitudinal length of the head 110). This hammer pattern may be modified as required by the end user, depending on their needs. At locations between rotor disks 120 where no shredder hammer 112 is provided on a particular hammer pin 124, the pin 124 may be covered with a pin protector 126, to protect the pin structure 124 from contact with and damage caused by the material 104 being shredded. These pin protectors 126, which may be of any desired size and/or shape, also may function (if desired) as a spacer between adjacent rotor disks 120.

In use, the rotor disks 120 are rotated as a unit about shaft 110A, e.g., by an external motor or other power source (not shown). The centrifugal force associated with this rotation causes the shredder hammers 112 to rotate about their respective pins 124 to extend their heavier blade ends 112E outward and away from the shaft 110A, as shown in FIG. 1A. As the rotation continues, the shredder hammer 112 will contact the material 104 to be shredded. Because it is rotatably mounted on the hammer pin 124, contact with the material 104 to be shredded may cause the shredder hammer 112 to slow down or even rotate in the opposite direction as it smashes the material 104 to be shredded against the anvil 108. The pins 124, pin protectors 126, hammers 112, spacers 122, and rotor disks 120 may be structured and arranged so that, in the event that a shredder hammer 112 is unable to completely pass through the material 104, it can rotate to a location between adjacent plates 120 and thereby pass by the material 104 until it is able to extend outward again under the centrifugal force due to rotation of the shredder head 110 about shaft 110A for the next collision. Also, in some instances, the shredder hammer 112 will shift sideways on its pin 124 as it passes by or through the material to be shredded. If desired, the various parts of the shredder head 110 may be shaped and oriented with respect to one another such that a shredder hammer 112 can rotate 360° around its pin 124 without contacting another pin 124, a pin protector 126, the drive shaft 110A, another hammer 112, etc. Shredding systems and heads of the types described above are known and used in the art.

As is evident from the above description, shredder hammers 112 are exposed to extremely harsh conditions of use. Thus, shredder hammers 112 typically are constructed from hardened steel materials, such as low alloy steel or high manganese alloy content steel (such as Hadfield Manganese Steel, containing about 11 to 14% manganese, by weight). Such materials are known and used in the art, such as in shredder hammers commercially available from ESCO Corporation of Portland, Oreg. Even when such hardened materials are used, the typical lifespan of a shredder hammer 112 may be a few days to a few weeks (e.g., depending, of course, on various factors, such as the material being shredded, amount of use, etc.). The shredder hammer blade or impact area 112E will tend to wear away over time and over repeated collisions with the material 104 to be processed, as shown in broken lines in FIG. 3, while the shredder hammer's mounting area 112F (the end where the hammer pin 124 is mounted) typically is hidden between adjacent rotor disks 120 and is not exposed to the material 104 being shredded (except perhaps at the exposed exterior edges and outer circumference of the disks 120).

FIGS. 2A and 2B show enlarged views of the edges of the openings 112A provided in shredder hammers 112 to receive the hammer pins 124. As shown in these figures, while the majority of the side walls 112B of these openings 112A are straight, flat, and parallel to one another in the axial direction L, the very corners 112C of the side wall 112B forming the opening 112A (i.e., where the interior side walls 112B meet the major surfaces 112D of the hammer 112) may be beveled (FIG. 2A) or rounded (FIG. 2B). These features may make it somewhat easier to insert the hammer pins 124 into the openings 112A, particularly when the diameter of the pin 124 is close in size to the diameter of the openings 112A (e.g., the curved or sloped corners 112C somewhat "funnel" the pin 124 into the opening 112A).

As noted above, shredder hammers 112 are exposed to extremely harsh conditions in use. The shredder hammers 112 themselves may weigh several hundred pounds (e.g., 150 to 1500 lbs). Moreover, these heavy hammers 112 slam into the material 104 to be shredded at relatively high rates of speed, and the material 104 to be shredded may constitute very hard materials, such as automobiles, automobile parts, etc. This slamming action and sideways movement of the shredder hammer as it impacts the material to be shredded causes repeated and highly stressful contact between the pin 124 and the side walls 112B of the pin openings 112A in the shredder hammers 112, particularly at the corners 112C of these openings 112A. While shredder hammers 112 typically are constructed from hardened steel materials, as noted above, shredder hammers 112 still often tend to develop cracks C in the mounting area 112F, as shown in FIG. 3, which can lead to early failure of the hammer 112 (e.g., before the blade area 112E is fully utilized). This early failure substantially increases costs in both parts and labor, and substantially slows and delays shredding operations.

Accordingly, there is room in the art for improvements in the structure and construction of shredder hammers and the machinery and systems utilizing such hammers.

SUMMARY OF THE INVENTION

The following presents a general summary of aspects of the present invention in order to provide a basic understanding of the invention and various example features of it. This summary is not intended to limit the scope of the invention in any way, but it simply provides a general overview and context for the more detailed description that follows.

Aspects of this invention relate to improved engagement between shredder hammers and the hammer pins that engage the hammers with the shredder heads. As more specific examples, aspects of this invention relate to shredder hammers that include a hammer body having a hammer mounting portion and a hammer blade portion, wherein the hammer mounting portion includes a mount opening defined therein that extends from a first major surface of the hammer body to a second major surface of the hammer body, wherein a pin mounting surface is provided within the mount opening for engaging a hammer pin, wherein at least a portion of the pin mounting surface is convex, and wherein at least some of the convex portion of the pin mounting surface is located within a central 90% of an overall thickness of the hammer body between the first and second major surfaces at the mount opening (the convex portion also may be located with the central 75% or even the central 50% of the mount opening thickness). The pin mounting surface may be provided directly on the hammer body (e.g., in an interior surface of the mount opening), or it may be provided as part of a separate member that is received in the mount opening (such as a bushing or a spool member). The convex portion of the pin mounting surface may extend at least 25% of the overall thickness of the hammer body at the mount opening location (and in some examples, at least 35%, at least 50%, at least 60%, or even through the entire thickness (100%) of the overall hammer body thickness at the mount opening location).

Some more specific aspects of this invention relate to shredder hammers in which at least a portion of the interior surface of the opening for receiving the hammer pin is curved in a direction moving from one major surface of the shredder hammer to the other major surface (i.e., through the thickness of the shredder hammer structure). If desired, the entire interior surface of the opening (e.g., around its entire circumference) may be curved.

According to additional aspects of this invention, the interior surface of the opening for the hammer pin may be smoothly curved in a direction moving from one major surface of the shredder hammer to the other major surface (i.e., through the thickness of the shredder hammer structure). For example, the interior surface along a section of the opening (or at least a major portion of the interior surface through the thickness of the hammer structure) may be smoothly formed as an arc of a circle, as a parabola, or as another smoothly curved surface, wherein the local extrema of the curved surface (i.e., its local minima or maxima) is located in the interior of the hammer pin opening (e.g., within the central 50% of the linear length of the curved surface, and in some examples, within the central 30% of the linear length of the curved surface).

Another aspect of this invention relates to shredder hammers in which the interior surface of the opening for the hammer pin, along a cross section of the opening, has multiple curve profiles. For example, the central portion of the surface (e.g., at a center of the thickness) may have one curve characteristic (e.g., a first radius) while the edge portions (i.e., adjacent to and near the major surfaces) may have different curve characteristics (e.g., a second radius different from the first radius, such as a smaller radius). The first curve characteristics may extend over a majority of the thickness of the opening in the hammer (e.g., over at least 50% of the overall linear length of the curve defining the interior surface of the opening, and in some examples, over at least 65% or even at least 75% of the overall linear length of this curve), while the other curve characteristics may exist over the remainder of the thickness (e.g., evenly divided at both edges, at only one edge, etc.), such as over less than 25%, 20%, 15%, 10%, or even 5% of the overall linear length of the curve defining the interior surface of the opening at each end portion of the opening. As an additional alternative, the interior surface may have a constantly changing curvature along a cross section of the opening moving from one major surface of the shredder hammer to the other.

In some more specific aspects of this invention, when the interior surface of the opening for the hammer pin is formed to have the cross section of an arc of a circle, the circle may have a radius $R_1$ corresponding to the formula $0.25 \leqq R_1/T \leqq 4$, wherein T is the thickness of the shredder hammer at the location of the hammer pin receiving opening. In some examples, the radius $R_1$ may satisfy the formula $0.5 \leqq R_1/T \leqq 4$, the formula $0.6 \leqq R_1/T \leqq 3$, or the formula $0.75 \leqq R_1/T \leqq 2$, or even include other arrangements outside these formulae. If the shredder hammer does not have a constant thickness at the location of the opening, then T represents the thickness of the opening at its thinnest location. While this same arc radius may be used throughout the entire thickness of the shredder hammer opening, in some examples of this invention, this radius will be used over at least the central 50%, and in some examples, it will be used over at least the central 65% or even at least the central 75% of the shredder hammer thickness. When the edge portions of the opening have different curve characteristics than the central portion, the edge portions may have a smaller radius than the central portion (e.g., at least 50% smaller), and in some examples, the edge portion radius "$R_2$" may be in a range of $0.05R_1$ to $0.5R_1$, and in some examples, within the range of $0.06R_1$ to $0.25R_1$, or within the range of $0.08R_1$ to $0.12R_1$, or even other arrangements outside of these formulae.

Additional aspects of this invention relate to shredder hammers that include a bushing member within a mount opening of the shredder hammer, wherein an interior surface of the bushing member (which receives the hammer pin) is continually curved in a direction from a first end of the bushing's hammer pin receiving opening to a second, opposite end of the bushing's hammer pin receiving opening. In such structures, the mount opening of the shredder hammer may have generally flat sides (e.g., as shown in FIGS. 2A and 2B), etc.

Still additional aspects of this invention relate to shredder hammers that include a mount opening in which a spool member is mounted and in which the hammer pin is received (i.e., the exterior surface of this spool member is received in the mount opening of the shredder hammer). In such example structures according to this invention, at least a portion of the interior surface of the shredder hammer mount opening and/or an exterior surface of the spool member (which engages the interior surface of the shredder hammer mount opening) may be continually curved from one end to the other end. Additionally or alternatively, if desired, the internal surface of the spool member (which engages the hammer pin) may be continually curved from one end to the other end.

Additional aspects of this invention relate to shredder hammers that have a hammer body including a hammer mounting portion and a hammer blade portion, wherein the hammer mounting portion includes a hammer pin receiving opening defined therein that extends from a first major surface of the hammer body to a second major surface of the hammer body. In this aspect of the invention, at least a central portion of an interior surface of the hammer pin receiving opening is curved such that a local extrema of the interior surface is located between the first major surface and the second major surface. The curved central portion of the interior surface may extend, for example, at least 25% of an overall thickness of the hammer pin receiving opening thickness.

Another aspect of this invention relates to shredder hammers having a hammer body including a hammer mounting portion and a hammer blade portion, wherein the hammer mounting portion includes a hammer pin receiving opening defined therein that extends from a first major surface of the hammer body to a second major surface of the hammer body. In this example aspect of the invention, at least a central region of an interior surface of the hammer pin receiving opening includes a plurality of flat, non-parallel surfaces, wherein each flat surface within the central region is joined to its adjacent flat surface within the central region at an obtuse angle. The "central region," as used in this specific context, constitutes a central 75% of an overall thickness of the hammer pin receiving opening thickness. This central region may include, for example, from 3 to 40 flat, non-parallel surfaces, and in some structures, from 5 to 30 flat, non-parallel surfaces.

Yet another aspect of this invention relates to shredder hammers having a hammer body including a hammer mounting portion and a hammer blade portion, wherein the hammer mounting portion includes a mount opening defined therein that extends from a first major surface of the hammer body to a second major surface of the hammer body. A separate pin engaging member is received in the mount opening, wherein the pin engaging member includes an exterior surface that engages the mount opening, and wherein the pin engaging member defines a hammer pin receiving opening including an interior surface for receiving a pin. The pin engaging member may constitute, for example a ball swivel member that is rotatable within the mount opening of the hammer body, a bushing member (that is optionally fixed to the hammer body at least partially within the mount opening), or a spool member (that extends within the mount opening and is optionally rotatable with respect to the hammer body).

Additional aspects of this invention relate to shredding systems and/or shredding heads including shredding hammers in accordance with examples of this invention, including shredding systems and shredding heads of the types generally described above in conjunction with FIGS. 1A and 1B (but with one or more shredder hammers in accordance with this invention mounted thereon). Any desired type of shredding system or shredding head (rotor) may include shredder hammers in accordance with examples of this invention, such as disc, spider, barrel rotors, etc.

Still additional aspects of this invention relate to methods of manufacturing shredder hammers, e.g., of the types described above. Such methods may avoid the need to use cores in the manufacturing process, which can reduce the time, costs, and complexity of the manufacturing process.

Other aspects, advantages, and features of the invention will be described in more detail below and will be recognizable from the following detailed description of example structures in accordance with this invention.

BRIEF DESCRIPTION OF THE DRAWINGS

The present invention is illustrated by way of example and not limited in the accompanying figures, in which like reference numerals indicate the same or similar elements throughout, and in which.

The reader is advised that the various parts shown in these drawings are not necessarily drawn to scale.

DETAILED DESCRIPTION

The following description and the accompanying figures disclose example features of shredder hammer structures and the engagement between the shredder hammers and hammer pins in accordance with the present invention. The description below includes information obtained as a result of investigation of premature failure of existing shredder hammer constructions. While the following description provides various theories as to why the failures occur and why the present invention may provide improvements over existing structures, nothing in this specification should be construed as limiting the invention to any particular mode or theory of operation.

Figure 3:
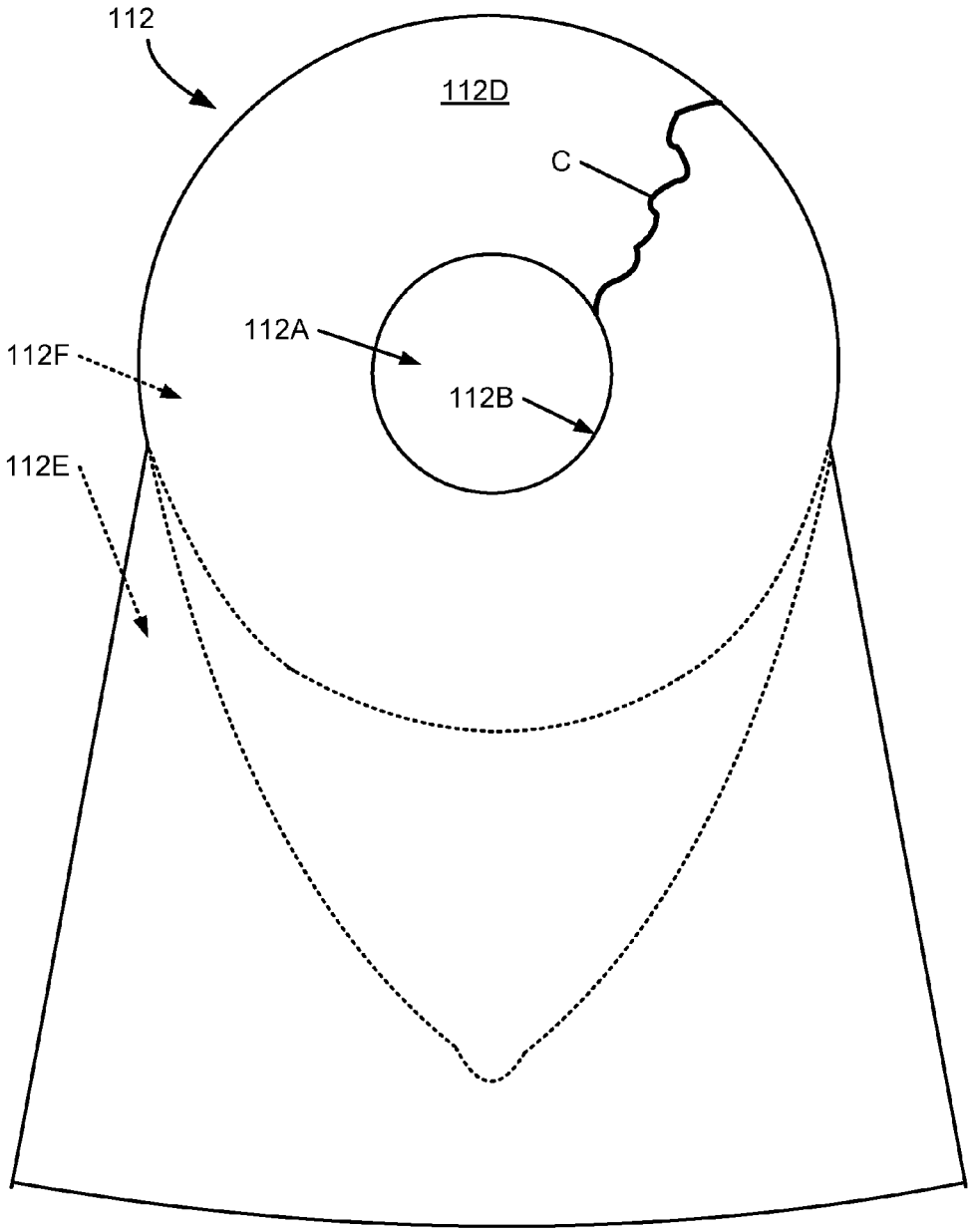
FIG. 3 is a visual aid used to help explain various typical characteristics and features of use of shredder hammer structures.

Due to the harsh conditions of use, in some instances, conventional shredder hammers have been prone to premature failure, e.g., when a crack forms at or near the edge of the hammer pin opening 112A and propagates across the major surface 112D of the hammer 112. See crack C in FIG. 3. Such cracks can form early in the life cycle of a shredder hammer 112, even before significant portions of the blade area 112E are abraded away or reduced by spalling.

Figure 2A:
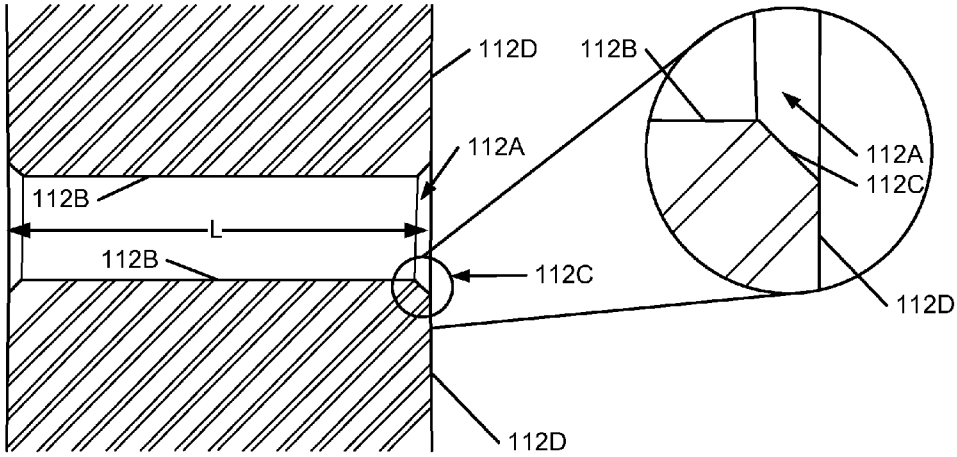
FIG. 2A (PRIOR ART)
FIGS. 2A and 2B illustrate more detailed features of hammer pin openings that are provided in conventional shredding hammers.
Figure 2B:
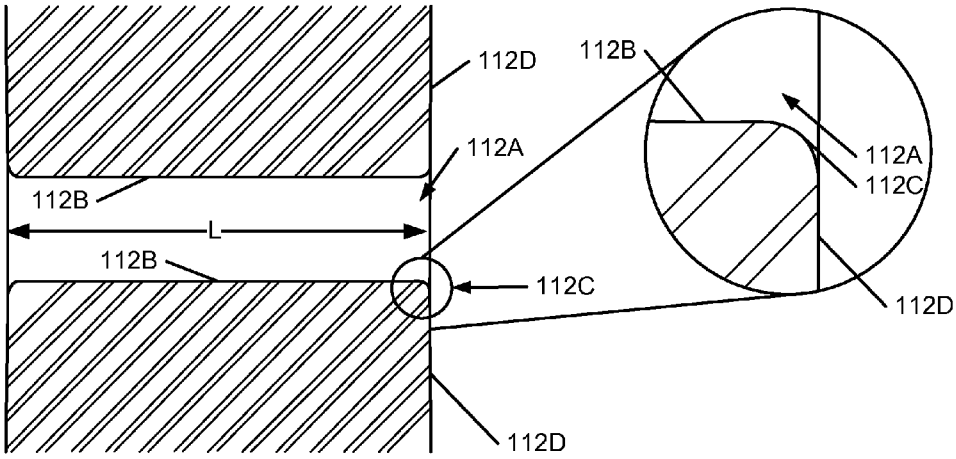
FIG. 2B (PRIOR ART)
Figure 4A:
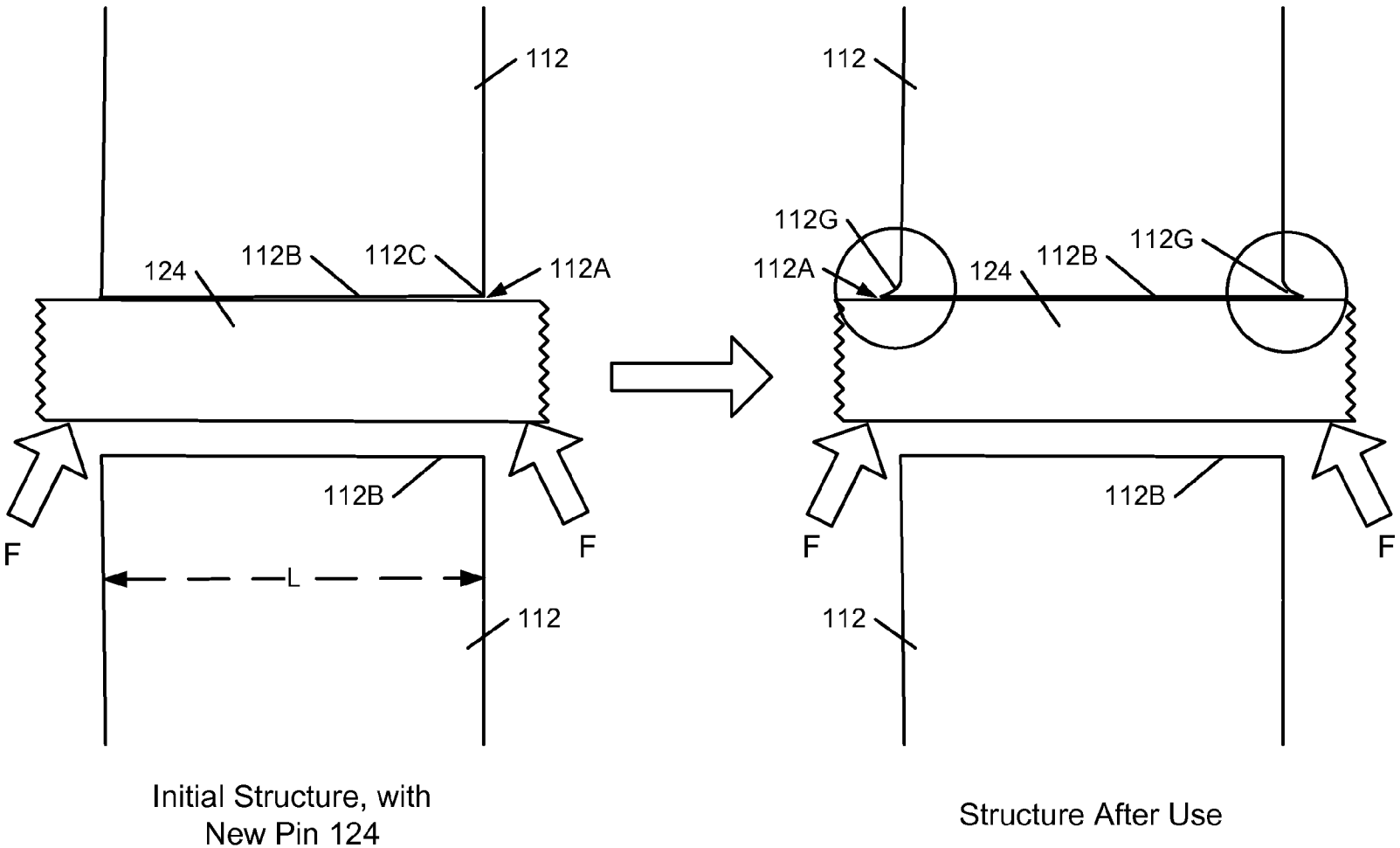
FIG. 4A (PRIOR ART)
FIGS. 4A through 4D are provided to assist in explaining characteristics and features of use, and one potential mechanism of operation and failure of conventional shredder hammers.

FIG. 4A illustrates the connection between a conventional shredder hammer 112 and its pin 124. Because the shredder hammer 112 is free to rotate about the pin 124, collisions between the shredder hammer 112 and the material 104 to be shredded (as the shredder head 110 rotates) also results in collisions between the interior walls 112B defining the shredder hammer pin opening 112A and the pin 124. Because the collision force F along the opening 112A will rarely (if ever) be uniform in magnitude and/or direction along the entire length L of the opening 112A, the forces F of the collisions are primarily absorbed at the corners 112C of the openings 112A (i.e., where the side walls 112B meet the major surfaces 112D). The inclusion of recessed or chamfers at the sides of conventional shredder hammer pin openings (e.g., as shown in FIGS. 2A and 2B) may further increase the stress concentration at the corners of the pin openings 112A because moving the corners inward (due to the chamfer or recess) shortens the lever arm between the contact points. The lever arm works to stop sideways twisting of the hammer 112 on the hammer pin 124.

In effect, the repeated collisions between the shredder hammer opening 112A and the pin 124 are believed to act to deform the steel material of the opening 112A at the very corners 112C thereof (e.g., akin to a forging process). The repeated collisions also tend to harden the material. More specifically, in this example arrangement, the repeated collisions between the shredder hammer opening 112A and the pin 124 at the corners 112C are believed to cause local, severe plastic deformation of the manganese steel material of the hammer 112. For some materials, such as the manganese steel material of some known shredder hammer constructions 112, this plastic deformation leads to "upsetting" (lateral deformation) of the steel material of the hammer 112, particularly at the corner edges of the opening 112A, as illustrated by the displaced material 112G shown in the right hand side of FIG. 4A (the "Structure After Use" portion of FIG. 4A). This upsetting process keeps increasing the hammer thickness near the hammer pin opening edge over time and in many cases may necessitate cutting off or trimming of the displaced material due to the upsetting process before the hammer is worn out in order to stop interference with the rotor. The need to stop operation of the shredder hammer for trimming results in shredder down time and weakens the hammer, thereby increasing the risk of catastrophic failure. The heat added in this trimming process can weaken the hammer at a critical location.

The displaced material areas 112G typically will be hardened due to their formation by the process described above. Despite being hardened, however, in the manganese steel material of some known shredder hammer constructions 112, this hardened material is also somewhat more brittle than the original manganese steel material of the shredder hammer construction 112. It is believed that the displaced material areas 112G and the increased brittleness resulting therefrom allow cracking or spalling to initiate at area 112G, and once the cracking begins, it propagates through other portions of the shredder hammer structure 112 causing the premature failures noted above.

Figure 4B:
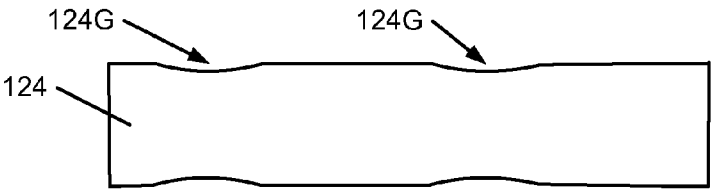
FIG. 4B (PRIOR ART)
Figure 4C:
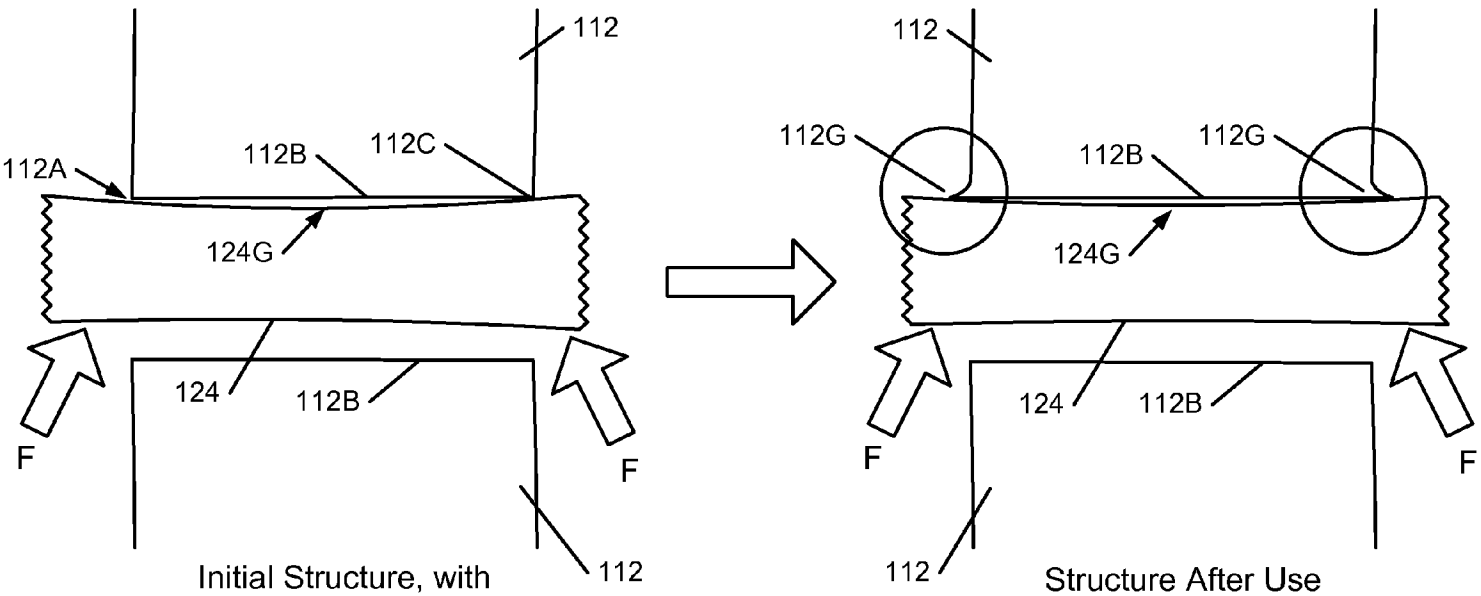
FIG. 4C (PRIOR ART)

While the above describes a potential mechanism explaining the premature failure of some known shredder hammer structures 112 when mounted on a new pin 124, this same type of failure also has been noted when these conventional shredder hammers 112 were mounted on used pins 124. In many instances, hammer pins 124 will outlast the shredder hammers 112 mounted thereon. Therefore, users will often mount new shredder hammers 112 on previously used pins 124. Over time, due to the collisions noted above, the pins 124 also may become worn such that a groove 124G is formed therein, as shown in FIG. 4B (FIG. 4B illustrates an example pin 124 in which two separate shredder hammers have been mounted, one shredder hammer at the left side groove 124G area and a second, separate shredder hammer at the right side groove 124G area). As shown in FIG. 4C, this "used pin" arrangement would appear to result in the same application of repeated impact forces at the corners 112C of the opening 112A for the hammer pin 124. In fact, if anything, the use of the used pin 124 appears to exacerbate the problem because even at the initial stages of use (on the left hand side of FIG. 4C), the pin 124 tends to only make corner edge contact with the opening 112A. The upsetting problems described above and/or the premature failure due to cracking does not appear to be substantially affected or remedied when the corners 112C are beveled or rounded, as shown in FIGS. 2A and 2B (as noted above, moving the corners inward due to the beveled or rounding features may actually increase the stress at the corners because the moment arm length is shortened).

Figure 4D:
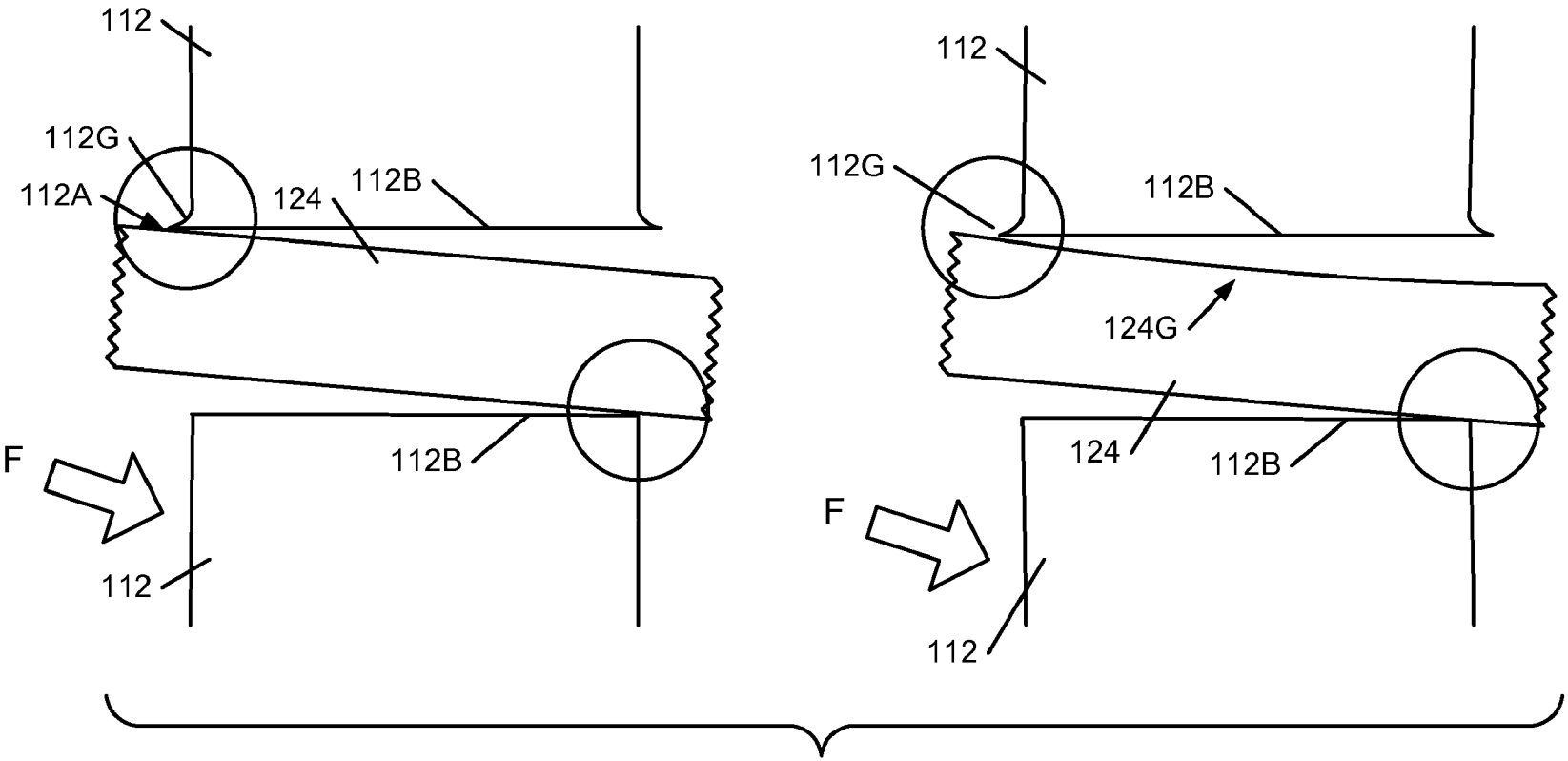
FIG. 4D (PRIOR ART)

FIG. 4D further helps illustrate the stresses to which shredder hammers (and particularly their pin openings) may be exposed during operation. FIG. 4D shows cross-sectional views of portions of shredder head constructions similar to those shown on the right hand sides of FIGS. 4A and 4C (i.e., a shredder head with a relatively new pin on the left hand side of FIG. 4D and a shredder head with a used pin on the right hand side of FIG. 4D). FIG. 4D, however, further shows the forces F to which the shredder hammers may be exposed during use (e.g., due to off center impact with the material to be shredded) and the resultant action of the hammer. Off center contact by the hammer blade on the material to be shredded may shift the hammer 112 on the pin 124 and cause the pin 124 to make forceful and repeated impact with the corner edges 112A of the pin opening (e.g., at the top and bottom edges as shown circled in FIG. 4D). This increased stress at the corner edges 112A can cause the upsetting issues described above. Additionally (or alternatively), the increased and repeated stress at the corner edge 112A of the hammer pin opening can cause elongation of the opening and/or bulging of this area, which can lead to cracking and spalling as mentioned above.

Figure 1A:
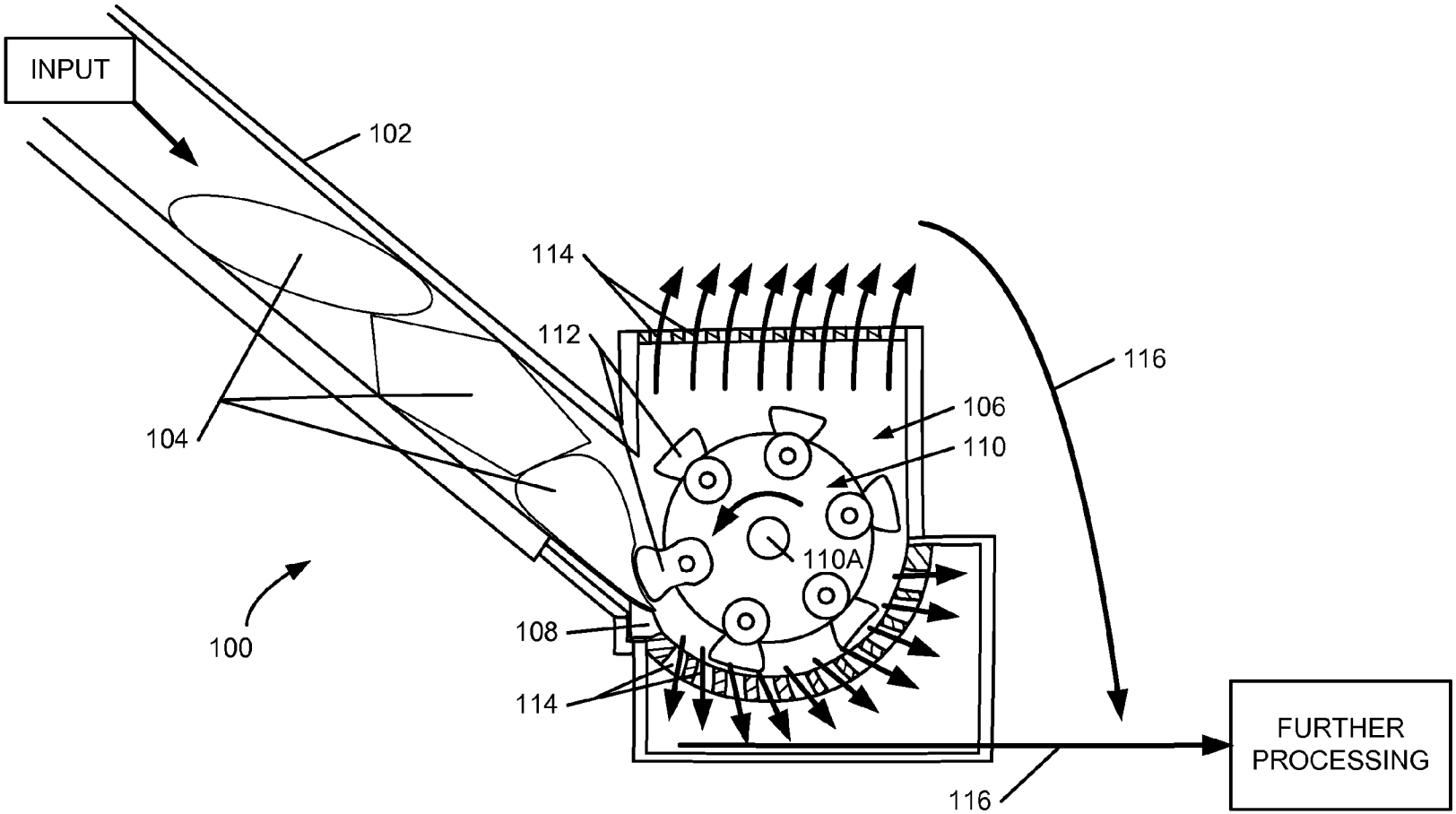
FIG. 1A (PRIOR ART)
FIGS. 1A and 1B illustrate features of conventional shredding systems and shredding heads.
Figure 1B:
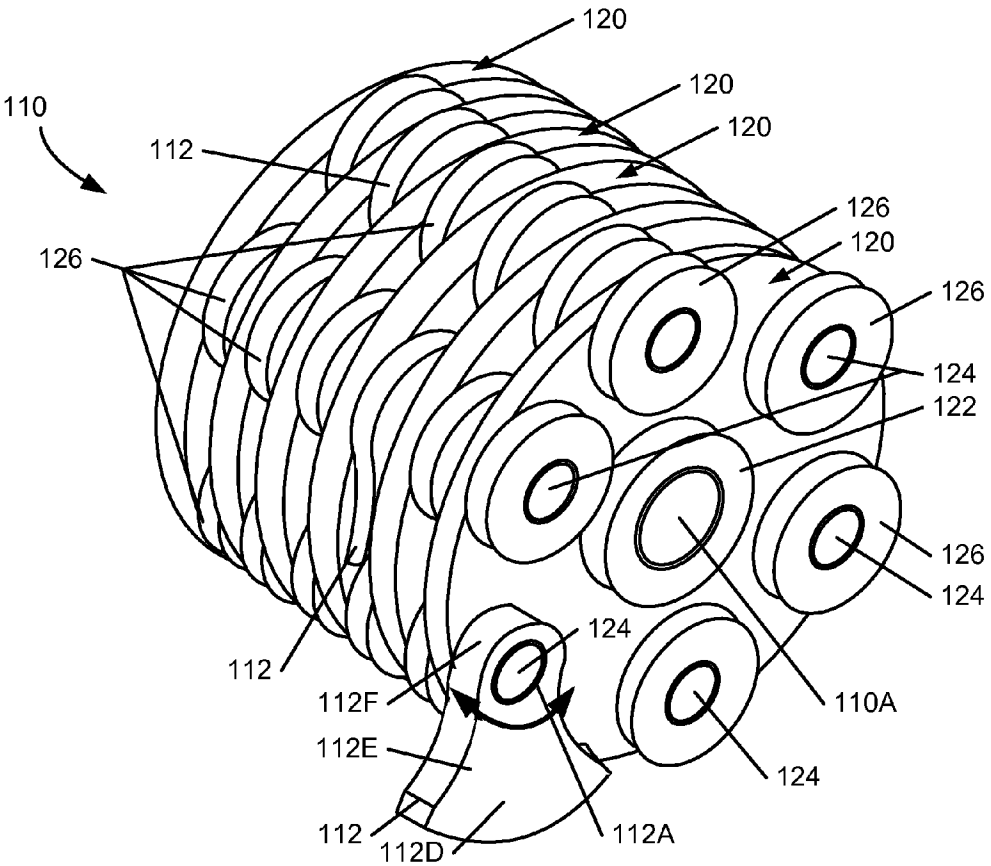
FIG. 1B (PRIOR ART)
Figure 5A:
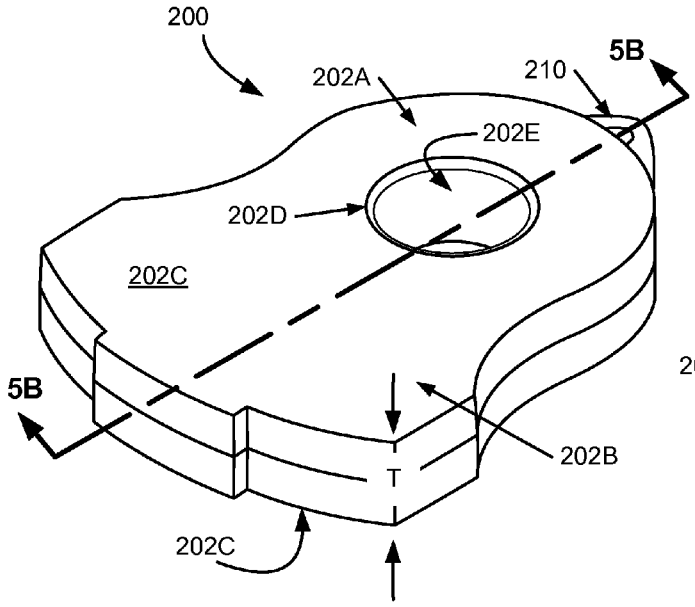
FIGS. 5A through 5C illustrate various views of an example shredder hammer structure in accordance with this invention.
Figure 5B:
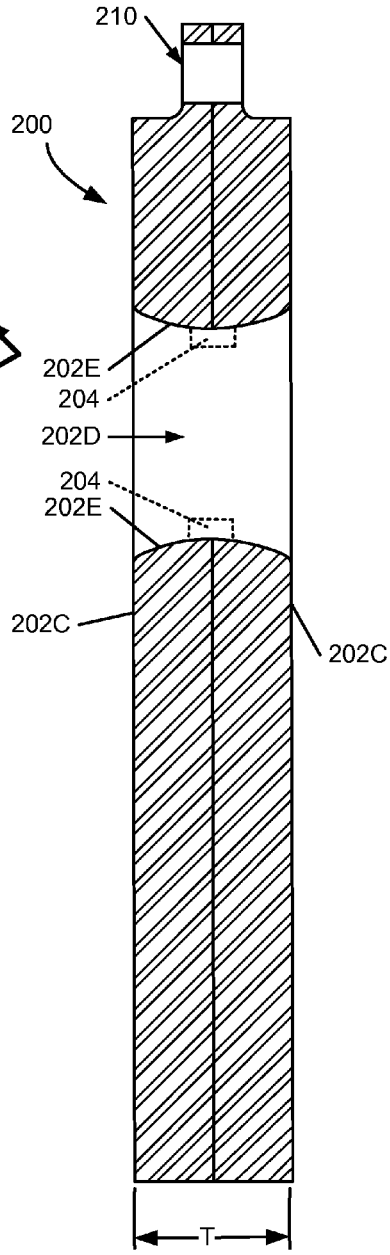
Figure 5C:
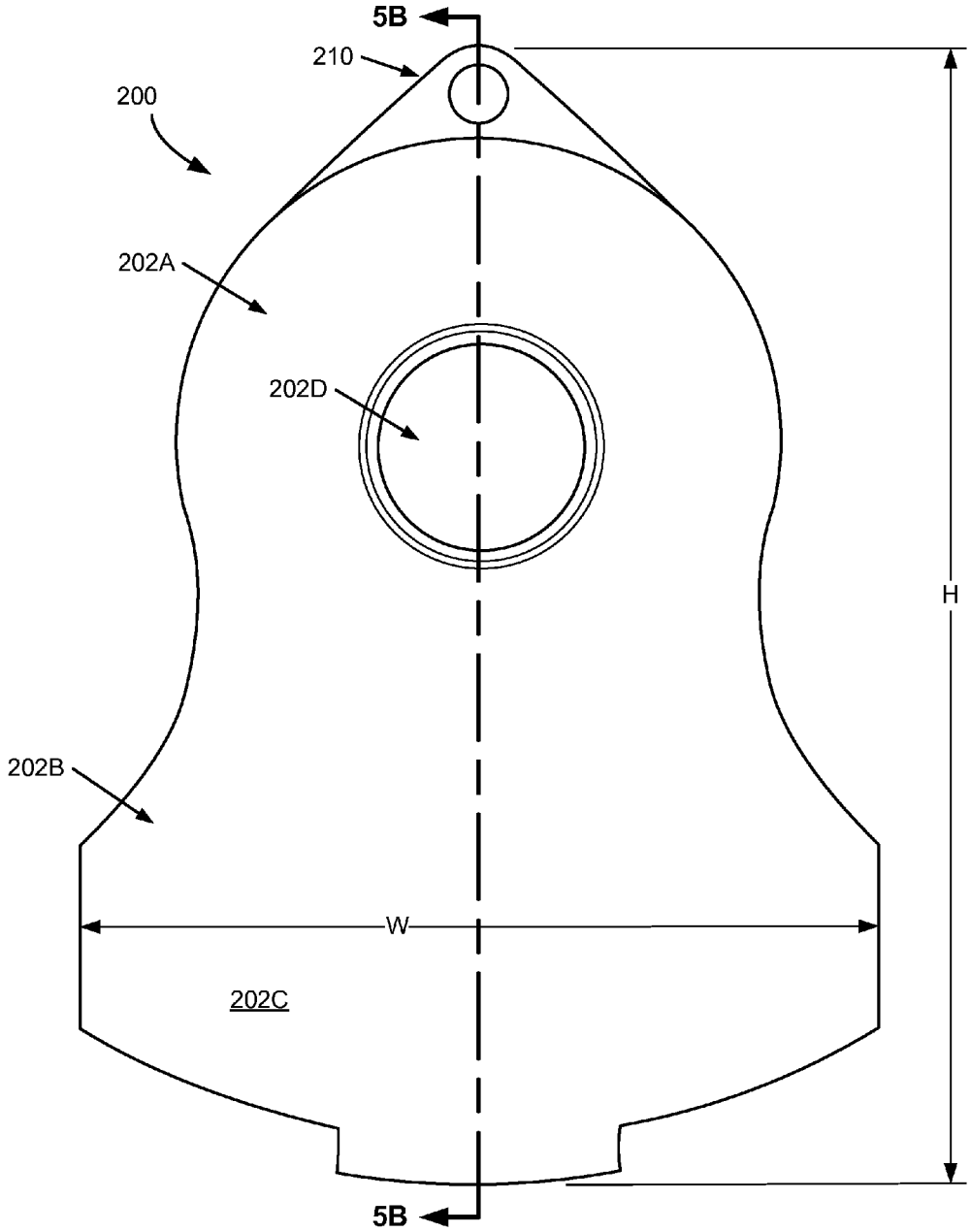

FIGS. 5A through 5C illustrate an example shredder hammer structure 200 in accordance with this invention. FIG. 5A shows a perspective view, FIG. 5C shows a front view, and FIG. 5B shows a central cross section view taken along line 5B-5B in FIGS. 5A and 5C. Shredder hammers 200 according to this invention may be used in any desired types of shredding systems and any desired types of shredding heads, including shredding systems 100 and shredding heads 110 of the types described above in conjunction with FIGS. 1A and 1B. When used in a shredding head, e.g., of the type illustrated and described above, the shredding head may include any desired number of rotor plates, any desired number of shredding hammers or spider arms, any desired number of hammer pins, in any desired arrangements and/or configurations of the various parts without departing from this invention. Moreover, the area between two rotor disks (when present) may contain any desired number of shredder heads according to this invention, in any desired arrangement or configuration.

This example shredder hammer 200 includes a mounting region 202A at which the head 200 is engaged with a hammer pin 124, and a hammer blade region 202B that contacts the material to be shredded during use. These regions 202A and 202B are set out for general discussion purposes and are not intended to demarcate precise areas or locations on the shredder hammer 200. The shredder hammer 200 may have any desired construction and/or external shape, including constructions (e.g., single piece or multi-piece) and/or external shapes that are conventionally known and used in the art. As one more specific example, as shown in FIGS. 5A and 5B, the shredder hammer 200 may be made from two or more individual plates that are joined together, e.g., in conventional manners, such as by welding or through the use of mechanical connector structures.

As shown in FIGS. 5A through 5C, the shredder hammer 200 includes two major surfaces 202C and a mount opening (e.g., a hammer pin receiving opening) 202D. The shredder hammer 200 also has a thickness T, which may be constant or may vary over the entire area of the hammer 200. A lifting eye 210 may be provided, if desired, to enable better and easier handling and movement of the shredder hammer structure 200.

At least some aspects of this invention relate to the structure of the hammer pin receiving opening 202D in shredder hammer structures 200. The opening 202D of this example structure generally has a round shape, as shown in FIGS. 5A and 5C, and it can receive a hammer pin 124 generally in the same manner as described above in conjunction with FIGS. 1A through 4C. At least some aspects of this invention, however, relate to the shape of the interior walls 202E of the shredder hammer structure 200 that define the opening 202D. As shown in the cross sectional view of FIG. 5B, the interior surface walls 202E defining the opening 202D are curved as one moves from one major surface 202C of the shredder hammer 200 to the other. Preferably, the curve will be oriented such that the local extrema of the curve will be located at or near a center point of the overall thickness T of the shredder hammer 200 (e.g., within the central 50% of the linear length of the curved surface 202E, and in some examples, within the central 30% of the linear length of the curved surface 202E). In some more specific examples, the local extrema may be located within a portion 204 of the surface 202E within 50% of the center of the overall thickness of the shredder hammer 200, and in some examples, the local extrema may be located within a portion of the surface 202E within 30% or even within 15% of the center of the thickness of the shredder hammer 200 (or even at the center thereof, as shown in FIG. 5B). In some example structures according to this invention, the local extrema will be at the midpoint of the surface 202E.

Figure 6:
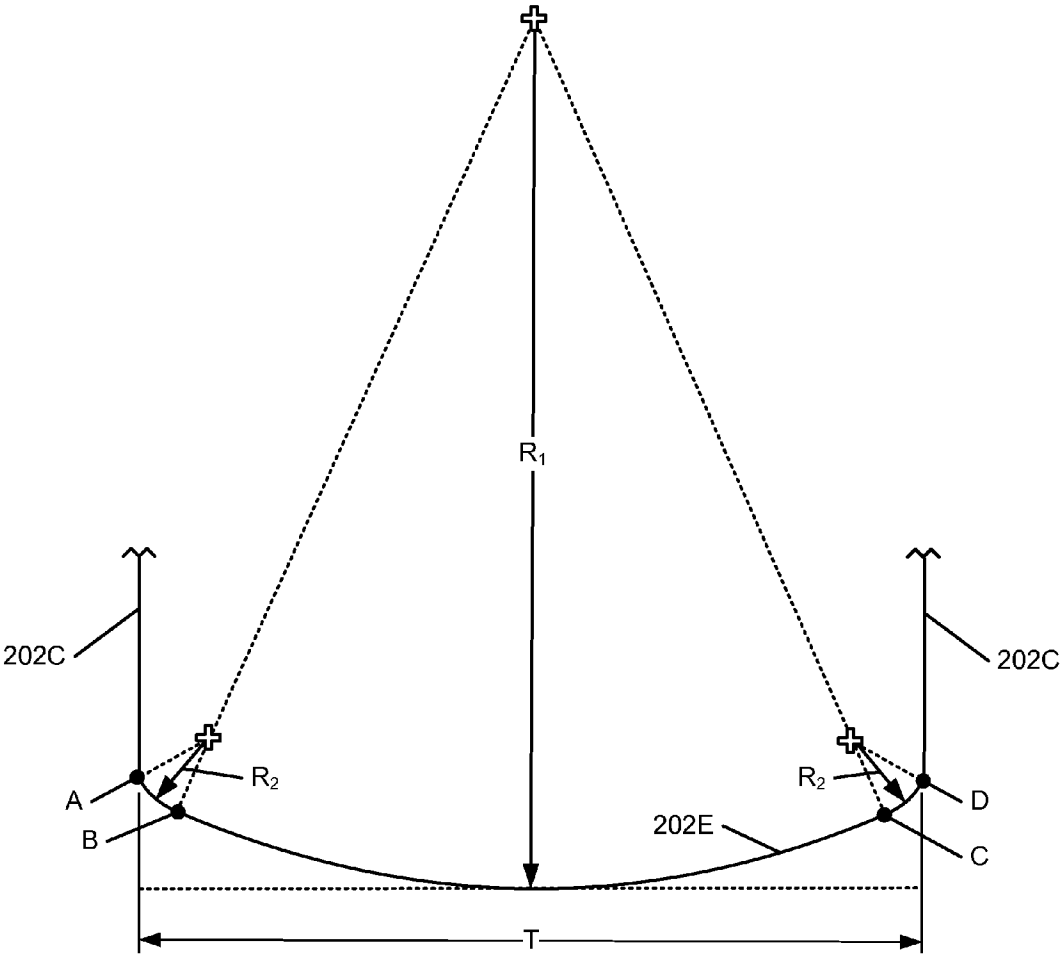
FIG. 6 provides a more detailed view of a cross section or surface profile of an interior surface of a shredder hammer pin opening in accordance with an example of this invention.

The interior surface 202E may be constructed to have a regular shape, such as an arc of a circle, a parabola, a hyperbola, etc. The interior surface 202E also may be formed as a single curve, a combination of plural curves, or a continuously changing curvature. FIG. 6 illustrates one more specific example of an interior surface 202E shape or construction that may be used in accordance with at least some examples of this invention. In this example construction, the central portion of the surface 202E (from point B to point C) has a first curvature characteristic (such as a first radius $R_1$), and the edge portions of the surface 202E (from point A to point B and from point C to point D) have different curvature characteristics from the first curvature characteristic (e.g., the edge portions may have greater curvature than the central portion). The two edge portions may have the same or different curvature characteristics from one another. As some more specific examples, the edge portions each may have a radius of curvature $R_2$ that is smaller than radius $R_1$ (i.e., more curved) and optionally, each of the end portions may have a radius $R_2$ that is within the range of $0.05R_1$ to $0.5R_1$, and in some examples, within the range of $0.06 R_1$ to $0.25R_1$, or even within the range of $0.08R_1$ to $0.12R_1$. As additional examples, the first radius $R_1$ may correspond to the formula $0.25 \leqq R_1/T \leqq 4$, wherein T is the thickness of the shredder hammer at the location of the hammer pin receiving opening. In some examples, the radius $R_1$ may satisfy the formula $0.5 \leqq R_1/T \leqq 4$, the formula $0.6 \leqq R_1/T \leqq 3$, or even the formula $0.75 \leqq R_1/T \leqq 2$. If the shredder hammer does not have a constant thickness around the opening 202D, then the thickness T corresponds to the smallest thickness dimension at the location of the opening 202D (i.e., the smallest hole thickness dimension).

Therefore, as shown in FIG. 6, the interior surface 202E of the opening 202D for the hammer pin, along a cross section of the opening 202D, may have a combination of multiple curve profiles. For example, the central portion of the surface (e.g., from points B to C in FIG. 6) may have one curve characteristic (e.g., the first radius $R_1$) while the edge portions (i.e., from points A to B and from points C to D in FIG. 6) may have different curve characteristics (e.g., a second radius different from the first radius, such as a smaller radius). The curve length between points B and C may extend over a majority of the overall curve length 202E of the opening (e.g., over at least 50% of the curve 202E's overall linear length, and in some examples, over at least 65% or even at least 75% of the curve 202E's overall linear length). The curves between points A and B and between points C and D, if desired, may exist over the remainder of the linear length of the curve 202E (e.g., evenly divided at both edges, at only one edge, with more at one edge than the other edge, etc.). Optionally, the curve length between points A and B and the curve length between points C and D will cover less than 25%, less than 20%, less than 15%, less than 10%, or even less than 5% of the overall curve length 202E of the opening. As another option, if desired, the entire curve 202E may have a single curvature (e.g., the $R_2$ curves could be omitted and the $R_1$ curves may extend to the major surfaces 202C). An individual curve 202E may have any desired number of regions having different curvature characteristics without departing from this invention. The curves (e.g., $R_1$ or $R_2$) need not be tangent to the outside major surfaces of the hammer body (e.g., the curve $R_1$ may be greater than 0.5T and it may extend to both of the major surfaces, if desired; see, for example, FIG. 17B).

Figure 7:
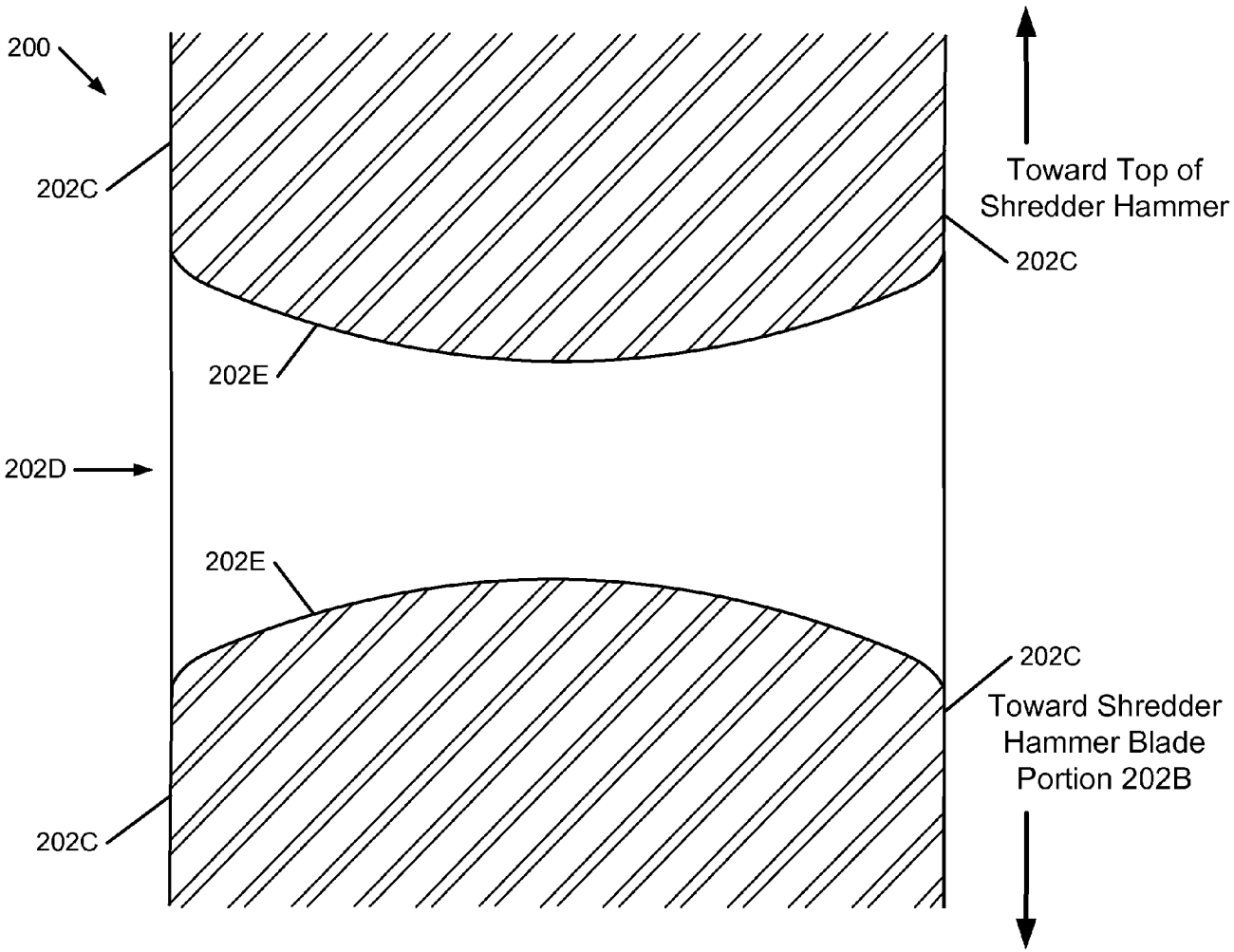
FIGS. 7 and 8 provide cross sectional views of shredder hammer pin openings of various shredder hammer constructions in accordance with examples of this invention.

FIG. 7 illustrates a cross sectional view at the location of a hole 202D in a shredder hammer 200 in accordance with one example of this invention, wherein the shredder hammer 200 has an interior hole surface 202E profile of the type described above in conjunction with FIG. 6. As shown in FIG. 7, in this example structure 200, the interior hole surface 202E has a uniform structure such that the top surface portion 202E of the hole 202D has the same profile as the bottom surface portion 202E of the hole 202D (i.e., the surfaces 202E shown in FIG. 7 are mirror images of one another). Moreover, the surfaces 202E are symmetric about a vertical centerline running through the center of the surfaces 202E and about a horizontal centerline running through the center of the opening 202D. Notably, as shown in FIG. 7, the very edge portions of the surfaces 202E are more rounded than the central portion thereof, as described above in conjunction with FIG. 6.

Figure 8:
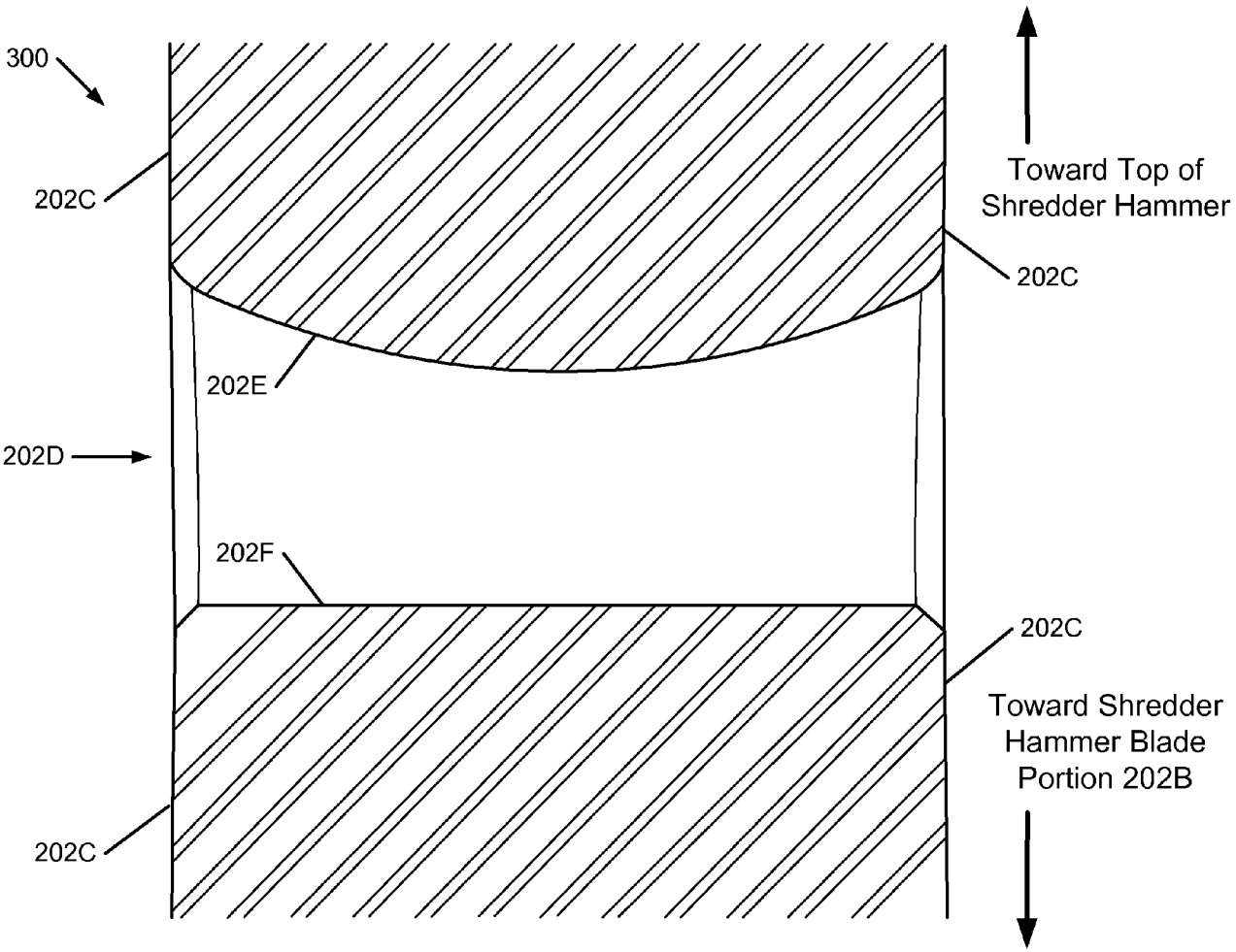

The uniformity and symmetry shown in FIG. 7 is not a requirement in all shredder hammer/hammer pin engagement constructions in accordance with this invention. Rather, if desired, as illustrated in FIG. 8, the opening 202D may be asymmetric, at least about a central axis running through the opening 202D (and optionally, if desired, asymmetric about a central axis running through the center of the surfaces 202E and 202F). More specifically, in this example structure 300, the top interior surface 202E of the opening 202D has the configuration described above in conjunction with FIGS. 6-7, but the bottom interior surface 202F of the opening 202D has a more conventional configuration (e.g., with rounded or beveled corner edges near the major surfaces 202C, with squared corners, etc.). At some location around the circumference of the opening 202D, there will be a transition region between the surface profile 202E and the surface profile 202F. This transition region may be relatively gradual or relatively abrupt, without departing from this invention. Thus, in this example structure 300, only a portion of the interior surface of the opening 202D has a continuous curvature characteristic as one moves from one major surface 202C to the other major surface 202C. More specifically, at least the primary load bearing portion of the interior surface of the opening 202D as the shredder hammer 300 rotates (e.g., under centrifugal force due to rotation of the hammer head on which the shredder hammer 300 is mounted), located within the opening 202D in a direction away from the hammer blade portion 202B (for example, the upper quarter, the upper half, or the upper three-quarters of the opening 202D as shown in FIG. 8), will have a continuous curvature characteristic. The portion of the opening 202D including the more conventional interior surface profile 202F may be located at regions of the opening 202D that tend to carry less load and experience less impact force (e.g., at areas where the potential for upsetting is reduced, such as the area of the interior surface of the opening 202D located nearer to the hammer blade portion 202B (e.g., the bottom quarter, bottom half, or bottom three-quarters of the opening 202D as shown in FIG. 8)).

Figure 9A:
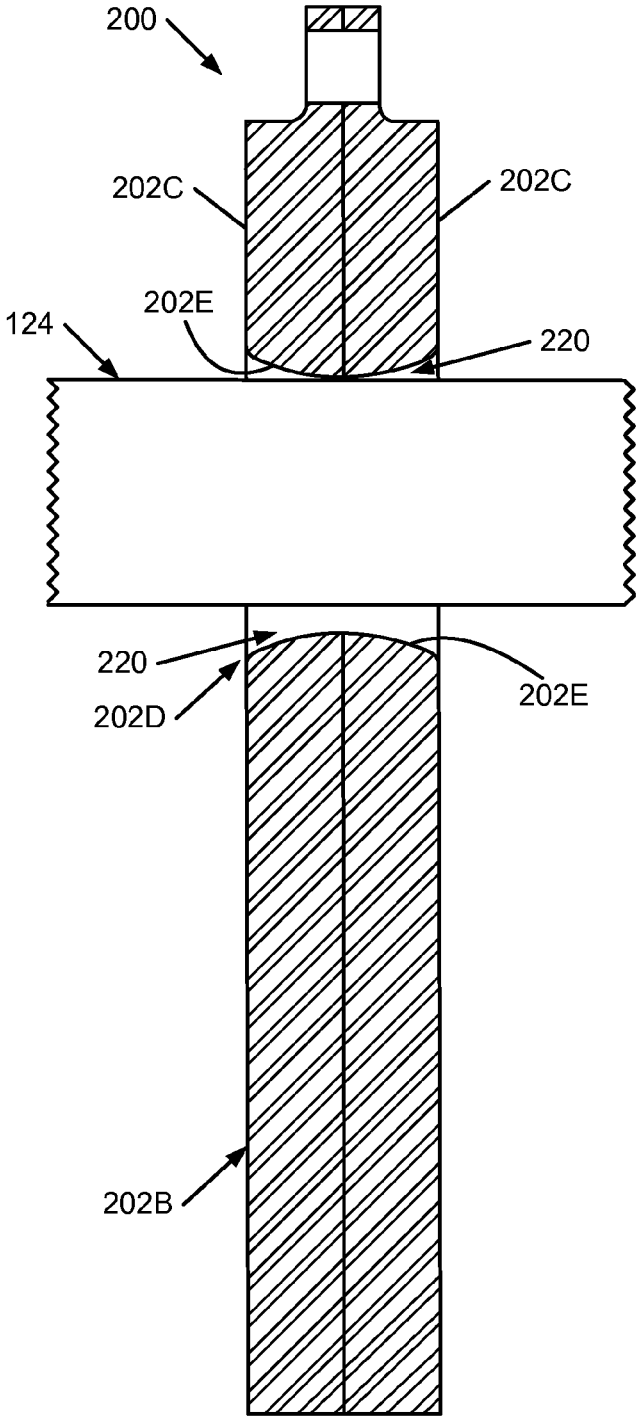
FIGS. 9A and 9B are similar views to FIGS. 4A and 4C, respectively, and are provided to assist in explaining characteristics and features of use, and possible mechanisms of operation of shredder hammers in accordance with this invention and how these characteristics, features, and mechanisms differ from those of conventional shredder hammers shown in FIGS. 4A and 4C.
Figure 9B:
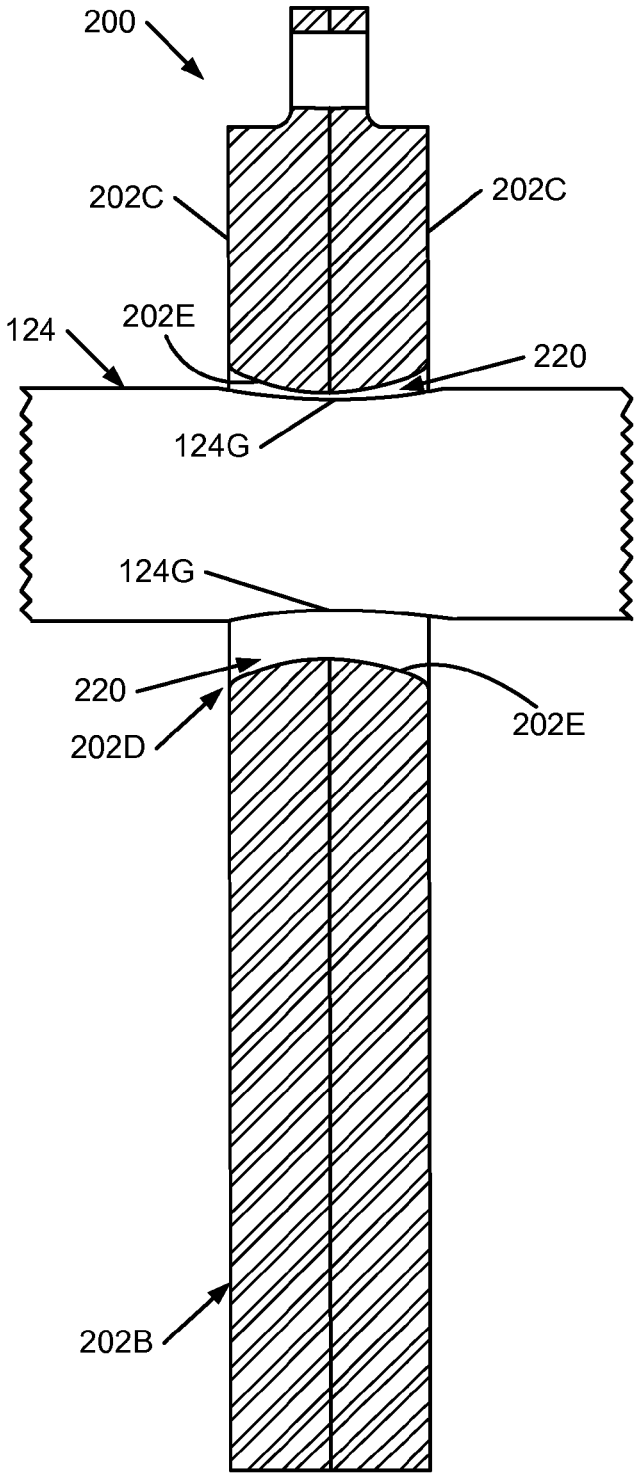

FIGS. 9A and 9B illustrate an example shredder hammer 200 in accordance with this invention having a hammer pin 124 mounted therein. In the arrangement illustrated in FIG. 9A, the hammer pin 124 is new (or relatively new) such that no substantial wear or grooved portions 124G are yet formed therein (see FIG. 4B). Notably, providing the curved interior surface 202E in the opening 202D produces contacts points between the pin 124 and the shredder hammer 200 within the central interior of the opening 202D (not necessarily at the very edges or corners of the opening 202D near the major surfaces 202C). Additionally, by providing the curved interior surface 202E in the opening 202D, the forces from the collisions between the shredder hammer blade area 202B and the material to be shredded are varied and spread among different areas and along a greater portion of the interior surface 202E (e.g., because the force is not always incident in the same direction). These features help prevent the impact force reaction area (between the pin 124 and the walls 202E of the opening 202D), and the absorption of the impact forces, from predominantly concentrating at the very edges and/or corners defining the junction between the opening 202D and the major surfaces 202C.

This dispersion or "spreading out" of the area of impact contact between the pin 124 and the interior surface 202E is believed to help spread out and delay concentrated upsetting of a specific hardened area due to the deformation mechanism described above in conjunction with FIGS. 4A and 4C. Moreover, the curved interior surface 202E provides "room" (e.g., pockets 220) for the upsetting procedure to occur within the interior of the opening 202D so that any lateral deformation region is not immediately located and/or exposed at the exterior major surfaces 202C of the shredder hammer 200. Moreover, the dispersion or "spreading out" of the area of impact contact between the pin 124 and the interior surface 202E will minimize or eliminate the upsetting issues described above.

As illustrated in FIG. 9B, similar results may be obtained even when shredder hammers 200 with a curved interior hammer pin surface 202E in accordance with this invention are used with worn pins 124 of the types illustrated and described above in conjunction with FIGS. 4B and 4C. As is evident from FIG. 9B, the incident forces resulting from collisions between the blade portion 202B of the shredder hammer 200 and the material to be shredded will result in contact between the hammer pin 124 and the interior surface 202E of the opening 202D. This contact will vary along the surface 202E, thus dispersing or "spreading out" the upsetting regions and avoiding concentration of lateral deformation at the very corner edges where the interior surface 202E meets the major surfaces 202C. The regions of increased curvature at the extreme corner edges (e.g., between points A and B and points C and D in FIG. 6) can further help avoid absorption of the incident forces at the corner edges of the opening 202D, particularly in this arrangement where the pin 124 is able to move somewhat more freely due to the grooved areas 124G. Preferably, the surface 202E will have a greater curvature (e.g., smaller radius) than the curvature of its corresponding grooved area 124G.

Figure 10:
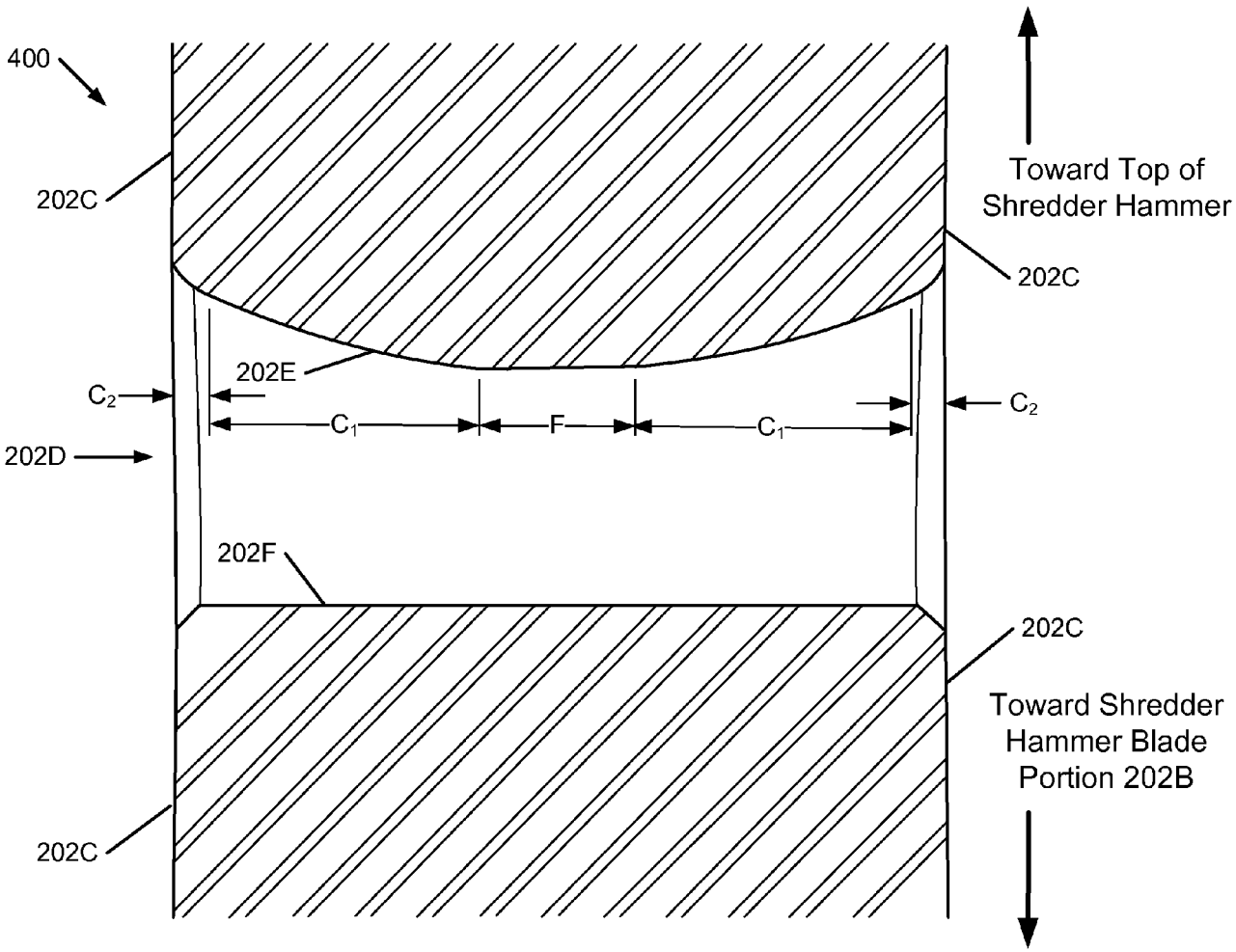
FIG. 10 provides a cross sectional view of a shredder hammer pin opening in accordance with another example of this invention.

FIG. 10 illustrates another example shredder hammer construction 400 in accordance with this invention. In this example structure 400, the top interior surface 202E of the opening 202D has a central portion (portion F) that is flat in this illustrated example structure 400, and curved portions are provided outside of the central portion F. While any desired curvature characteristics may be provided in the curved portions (e.g., a single curvature, multiple curvatures, or a continually changing curvature), in this illustrated example structure 400, the top interior surface 202E may have a first curvature section $C_1$ immediately outside the central portion F and within the interior of the opening 202D (e.g., having the dimensional characteristics of $R_1$ described above) and a second curvature section $C_2$ located immediately outside the first curvature section $C_1$ and adjacent the exterior edges of the opening 202D (the areas opening to the major surfaces 202C). While shown the same, the curvature $C_1$ on one side of the central portion F may be different from the curvature $C_1$ on the other side of the central portion F. Likewise, the curvature $C_2$ on one side of the central portion F may be the same as or different from the curvature $C_2$ on the other side of the central portion F. Moreover, while the bottom surface 202F shown in FIG. 10 is the same as that shown in FIG. 8, this bottom surface 202F may have the same surface characteristics of the top surface 202E in FIG. 10 (such that the entire opening 202D is symmetrical about a horizontal axis), or it may have other curvature or non-curved characteristics without departing from this invention.

As noted above, the central portion F may be flat in some example structures 400 according to this invention. While it may be centered within the axial length of the opening 202D (as illustrated), this is not a requirement (i.e., the flat portion F may be offset from the center such that its center is not precisely at the linear center of the surface 202E). Nonetheless, this central portion F should not be positioned and should not be so large as to result in the cracking problems illustrated and described above in conjunction with FIGS. 4A through 4C. In some example structures according to the invention, the ends of the central portion F will be located within the central 50% of the overall linear length of the surface 202E, and in some examples, these ends will be located within the central 25% or even within the central 10% of the overall linear length of the surface 202E. The portions of the surface 202E corresponding to each of the first curvature sections $C_1$ may cover from 5% to 48% of the overall linear length of the surface 202E of the opening 202D, and the edge portions corresponding to each of the second curvature areas $C_2$, when present, may cover less than 20%, less than 15%, less than 10%, or even less than 5% of the overall linear length of the surface 202E of the opening 202D. An individual curve 202E may have any desired number of flat regions and regions having different curvature characteristics without departing from this invention.

Also, while the entire interior surface of the opening 202D may have the cross sectional profile shown as element 202E in FIG. 10, this is not a requirement. If desired, in some structures according to this invention, at least the primary load bearing portion of the interior surface of the opening 202D as the shredder hammer 300 rotates (e.g., under centrifugal force due to rotation of the hammer head on which the shredder hammer 300 is mounted), located within the opening 202D in a direction away from the hammer blade portion 202B (for example, the upper quarter, the upper half, or the upper three-quarters of the opening 202D as shown in FIG. 8), will have the profile shown as element 202E in FIG. 10.

Additionally, the central area F need not necessarily be perfectly flat, but it may have a curvature (outwardly or inwardly) or other surface structure without departing from this invention. Preferably, the transition regions between the central area F and the areas of curvature $C_1$, as well as the transition regions (if any) between areas of curvature $C_1$ and $C_2$ will be relatively smooth and devoid of abrupt or pronounced corners so that the upsetting phenomena described above is avoided or minimized. Also, preferably, the transition regions between the central area F and the areas of curvature $C_1$ will be located well within the interior of the opening 202D so that any upsetting that is induced will remain within the interior of the opening 202D, will be spread apart along the surface 202E, and/or will not extend to the exterior surface 202C of the hammer structure 400.

Figure 11A:
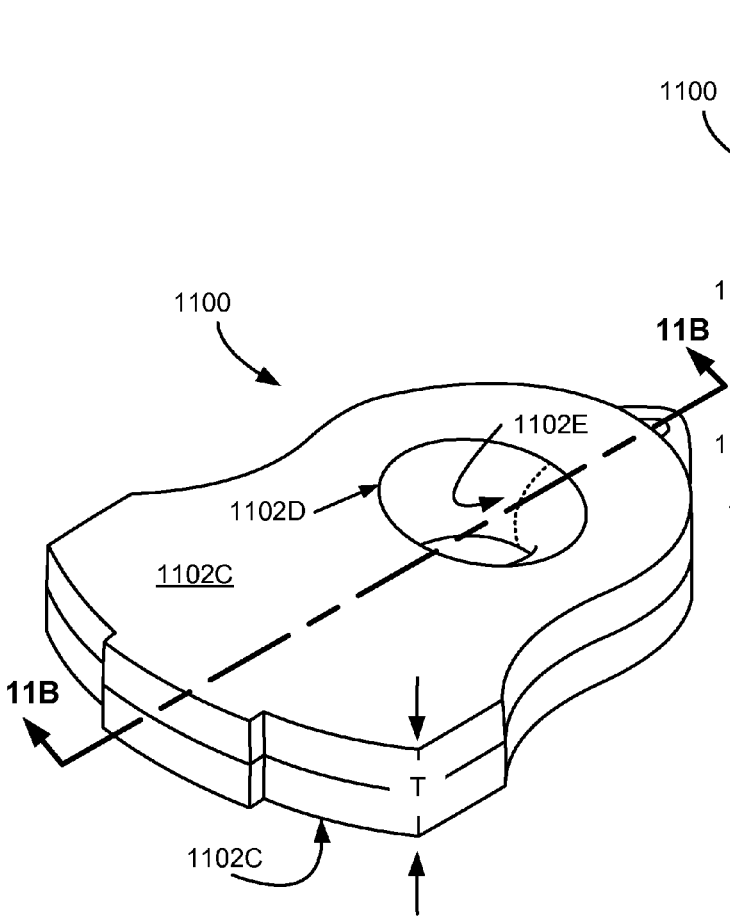
FIGS. 11A through 11C illustrate various views of another example shredder hammer structure in accordance with this invention.
Figure 11B:
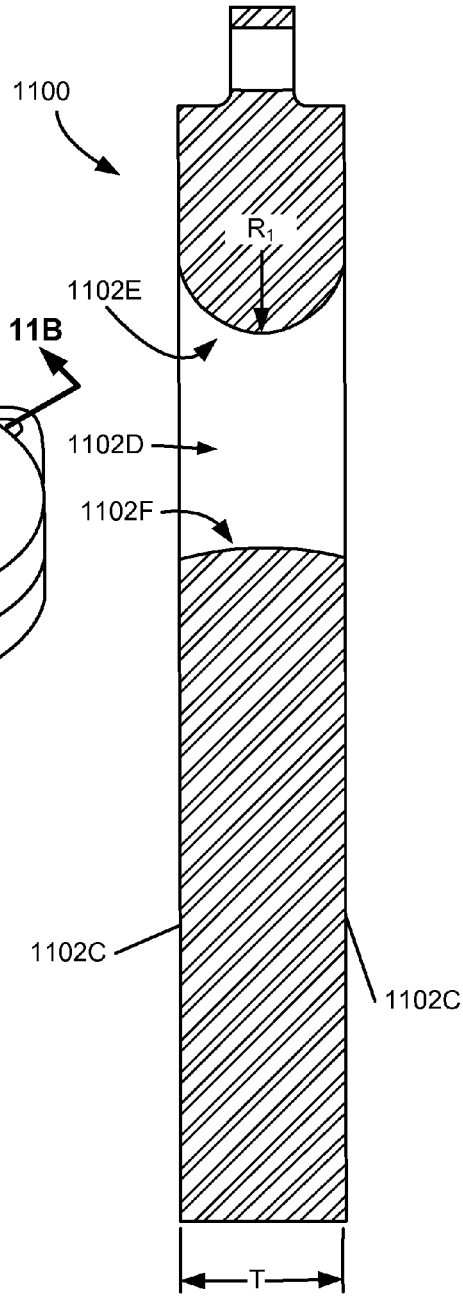
Figure 11C:
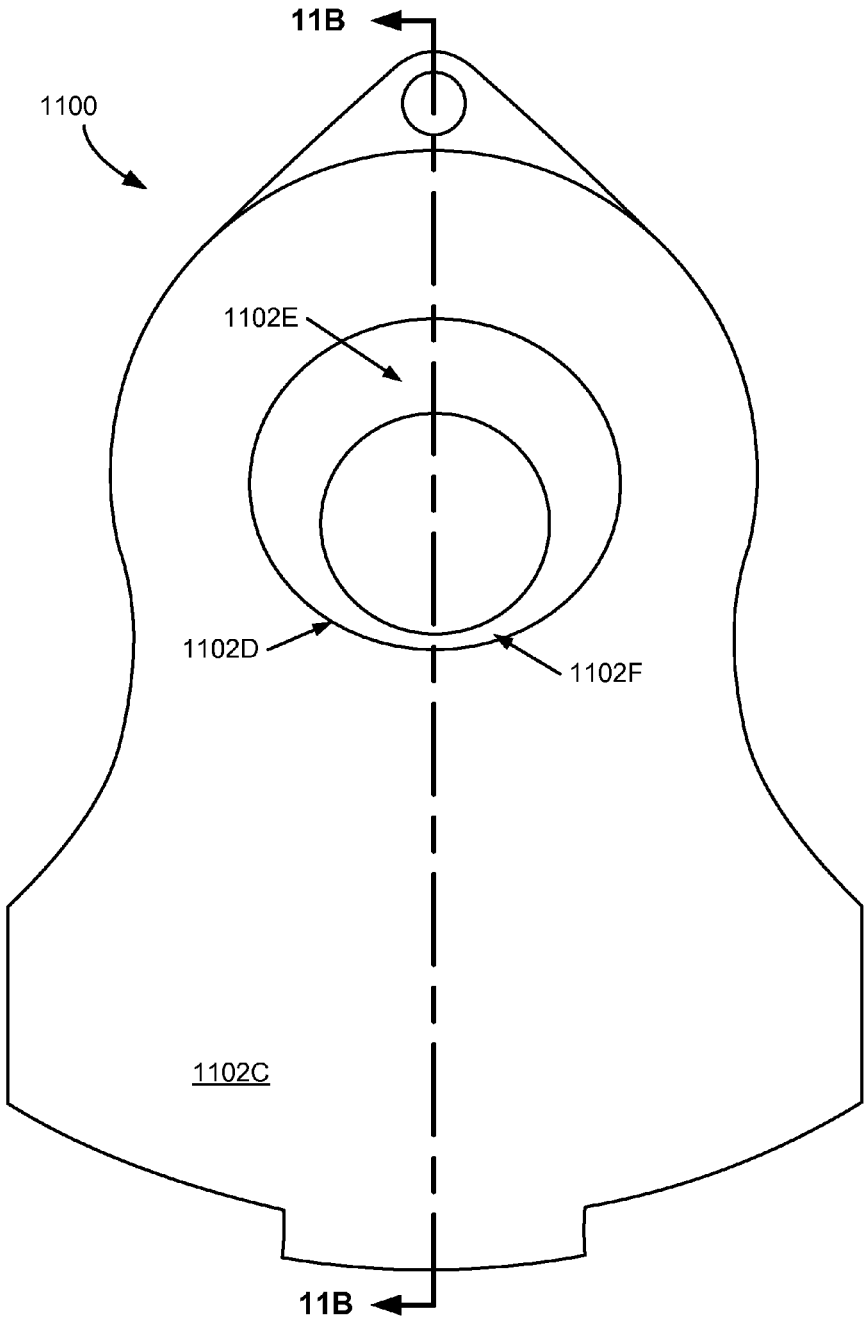

FIGS. 11A through 11C show perspective, cross sectional, and plan views of another example shredder hammer structure 1100 in accordance with this invention. The construction 1100 is similar to the shredder hammer structure 200 described above in conjunction with FIGS. 5A through 5C, except various features in relation to the hammer pin receiving opening 1102D. As illustrated in these figures, the upper interior surface 1102E of the hammer pin receiving opening 1102D of this example structure 1100 is very curved as one moves from one major surface 1102C of the shredder hammer 1100 to its other major surface 1102C (and more curved than the illustrated surface 202E shown in FIGS. 5A through 5C). In some examples of this shredder hammer construction 1100, at least a portion of the interior surface 1102E of the hammer pin receiving opening 1102D (e.g., such as the upper, main weight bearing portion, such as the upper quarter, upper half, or upper three-quarters, as shown in FIGS. 11B and 11C) will have a radius $R_1$ equal to one half of the overall thickness T of the shredder hammer 1100 at the location of the opening 1102D. In this manner, the curve of the interior surface 1102E will be tangent to the major surfaces 1102C at the outer edges of the interior surface 1102E. While the bottom interior surface 1102F of the hammer pin receiving opening 1102D may have the same shape as the upper surface 1102E, this surface 1102F also may have any of the other profiles described above, including somewhat curved (e.g., as shown in FIGS.

5A through 5C), somewhat flat (e.g., as shown in FIG. 8), or other. When the surfaces 1102E and 1102F have different shapes or profile, the transition between the shapes or profiles may be gradual, smooth, or abrupt, e.g., as generally described above.

In this manner (as well as with the other curved load bearing surfaces described above), as illustrated in FIGS. 12A and 12B, the hammer pin opening 1102D starts with bearing contact between the hammer pin opening 1102D and the hammer pin 124 more toward the centerline of the hammer pin opening 1102D. For example, as shown in the left hand sides of FIGS. 12A and 12B, for either a new pin 124 (FIG. 12A) or a worn pin 124 (FIG. 12B), the initial load bearing contact point is substantially at the centerline of the hammer 1100. During use, as described above, the material of the hammer pin receiving opening 1102D may be laterally deformed and start to upset and the manganese (or other material) may start to harden, but in this example structure 1100, this upsetting and hardening starts to occur more toward the hammer pin opening 1102D centerline, not at the outer edges of the hammer pin opening 1102D. The initial single point contact with the relatively soft manganese (or other material, in some hammer constructions) at the centerline allows (provides room for) the hammer pin receiving opening 1102D to laterally deform and to form to and match the surface of either a new or worn pin 124 surface. As it forms and is displacing the manganese (or other material), the bearing area in the interior of the opening 1102D becomes work hardened with the highest hardness values at the centerline (and not cracked, spalled, and useless at the outer edges of the opening as described above in conjunction with FIGS. 4A and 4B). As shown at the right hand sides of FIGS. 12A and 12B, even when the hammer 1100 is forced sideways on the pin 124 (e.g., due to collisions with the material to be shredded), contact between the pin 124 and the hammer pin opening 1102D remains within the interior surface 1102E of the hammer pin opening 1102D.

Figure 12A:
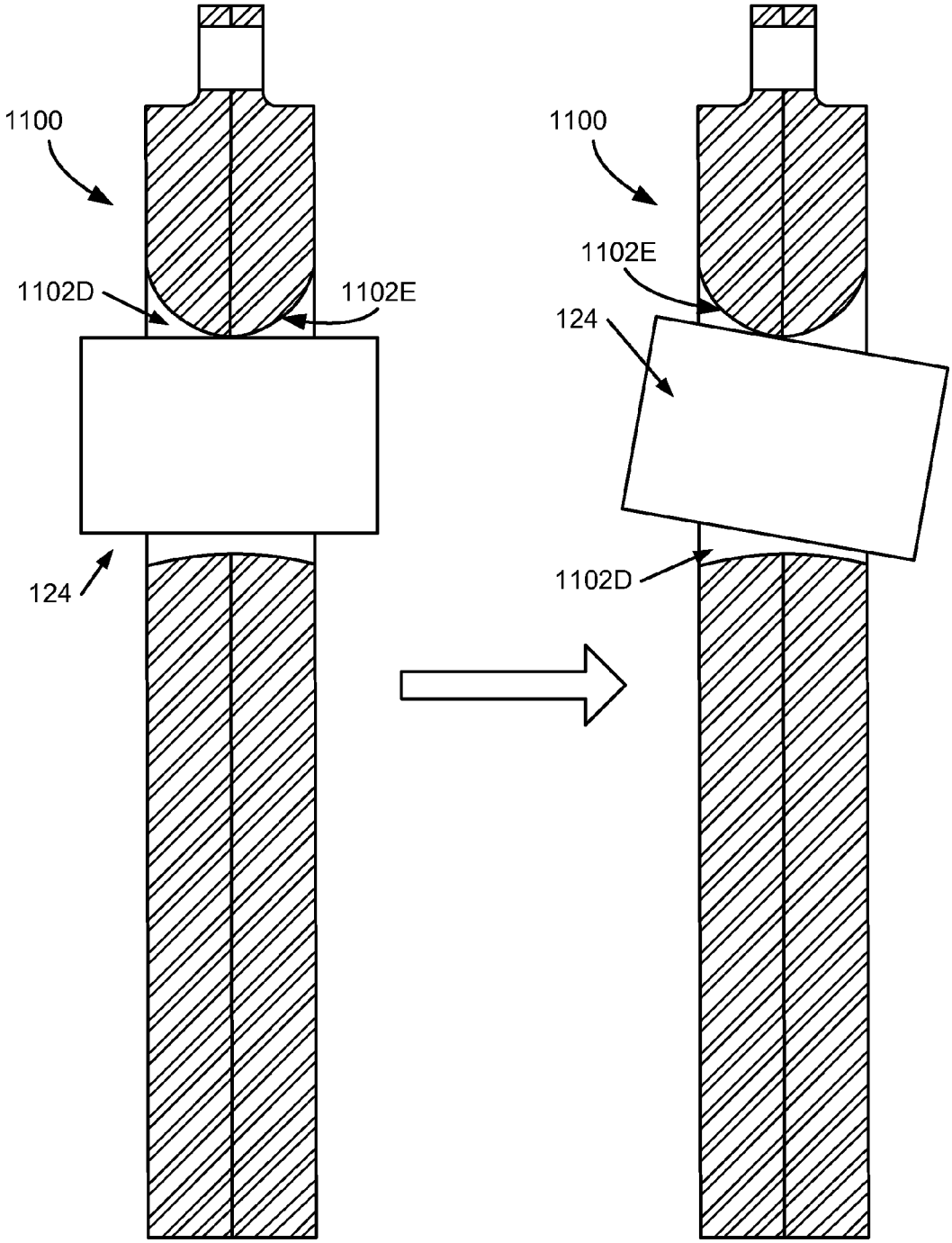
FIGS. 12A and 12B are provided to assist in explaining characteristics and features of use, and possible mechanisms of operation of shredder hammers in accordance with examples of this invention.
Figure 12B:
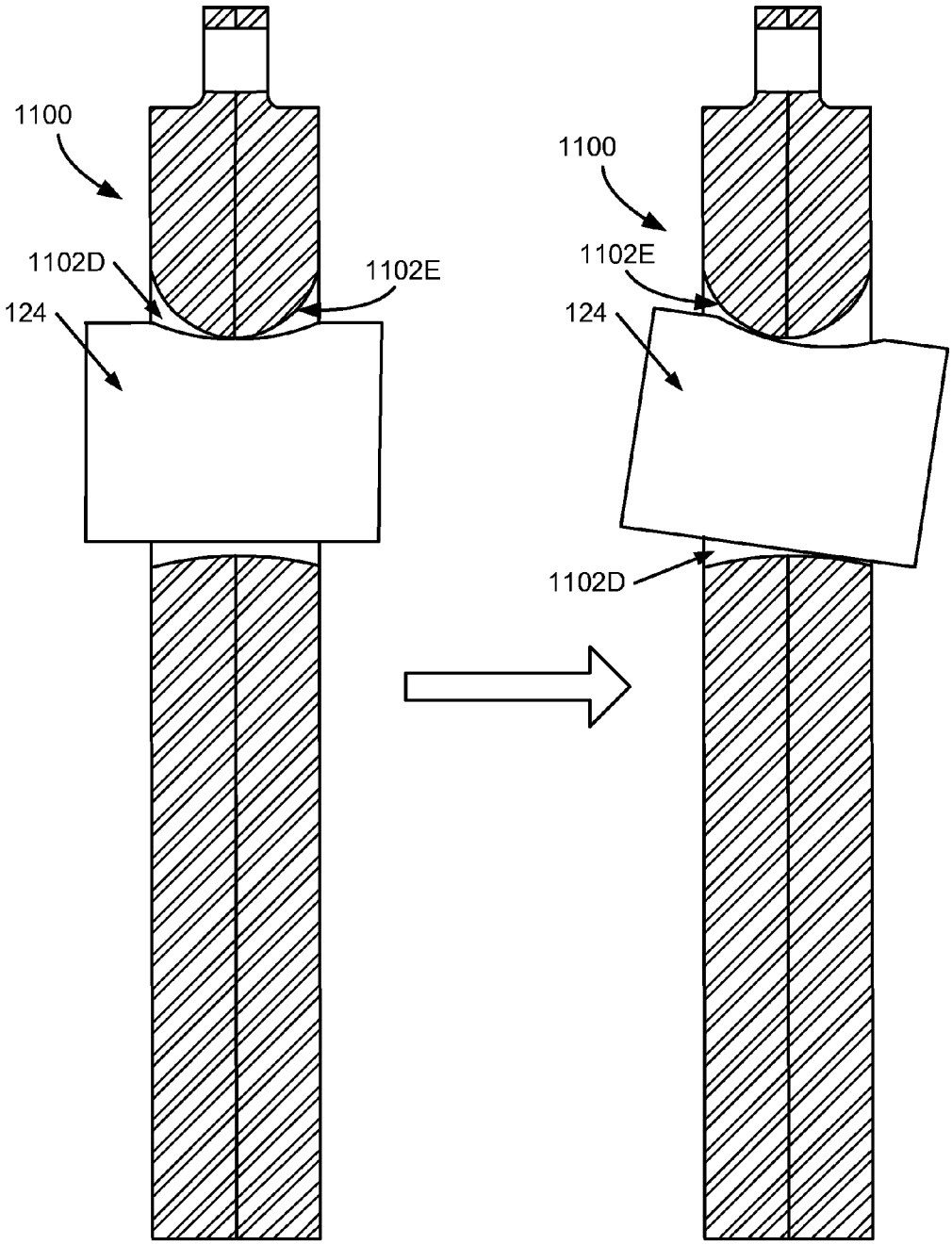

As further shown in FIGS. 12A and 12B, the curved surface 1102E supports the working load at or near the hammer centerline, even when the hammer 1100 is swinging well off center. Additionally, as the hammer 1100 moves back to a central rotating position or to the opposite side (e.g., due to a collision with the material to be shredded), it easily rolls along the curved pin opening surface 1102E. This rolling action re-hardens the pin opening surface 1102E. Also, this rolling action (and the overall reduced material flow and material deformation as described above) may generate less heat than a sliding action as occurs with conventional hammer pin openings, and this reduction in heat can help reduce damaging heat build up and help the hammer and pin to last longer.

The curved interior hammer pin opening surface (e.g., surfaces 202E and 1102E) helps keep the highest working load of the hammer 1100 at the strongest part of the hammer pin opening, i.e., at its centerline. Thus, this construction is far less likely to overload the mechanical properties of the hammer material (particularly a manganese hammer material), which helps reduce pin opening stretching (i.e., deformation of the shape of the pin opening). The curved bearing surfaces (e.g., surfaces 202E and 1102E) also greatly reduce or eliminate unsupported material (e.g., manganese) flow and spalling at the outside edges of the hammer pin opening. These features reduce or eliminate expansion of the width (or thickness) of the hammer and the need to trim the hammer to stop interference problems (e.g., interference with the rotor or divider plates of the shredding head, etc.).

As another potential advantage, the curved interior hammer pin opening surfaces (e.g., surfaces 202E and 1102E) reduce somewhat the amount of material in the shredder hammer structure 200, 1100 (for example, by eliminating pounds of metal around the opening due to the larger opening size at the outside edges). This feature provides better distribution of material without elimination of any wear material or reduction in the impact force on the material to be shredded.

All of the above described structures include the hammer pin directly engaged with the hammer body at a hammer pin receiving opening defined in the hammer body. This is not a requirement. Rather, if desired, various example structures according to this invention may include a separate pin engaging member that engages the hammer body at the hammer body's mount opening such that the pin directly engages the pin engaging member which in turn directly engages the hammer body. Various examples of such structures are described below.

Figure 13A:
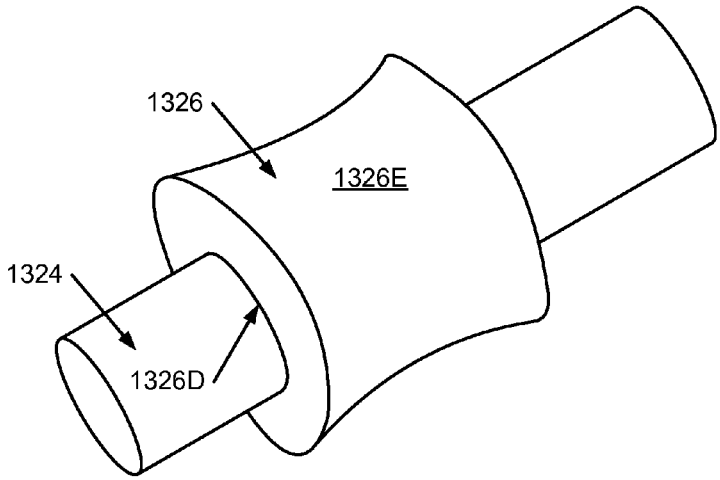
FIGS. 13A and 13B illustrate various views of another example shredder hammer and hammer pin construction in accordance with this invention.
Figure 13B:
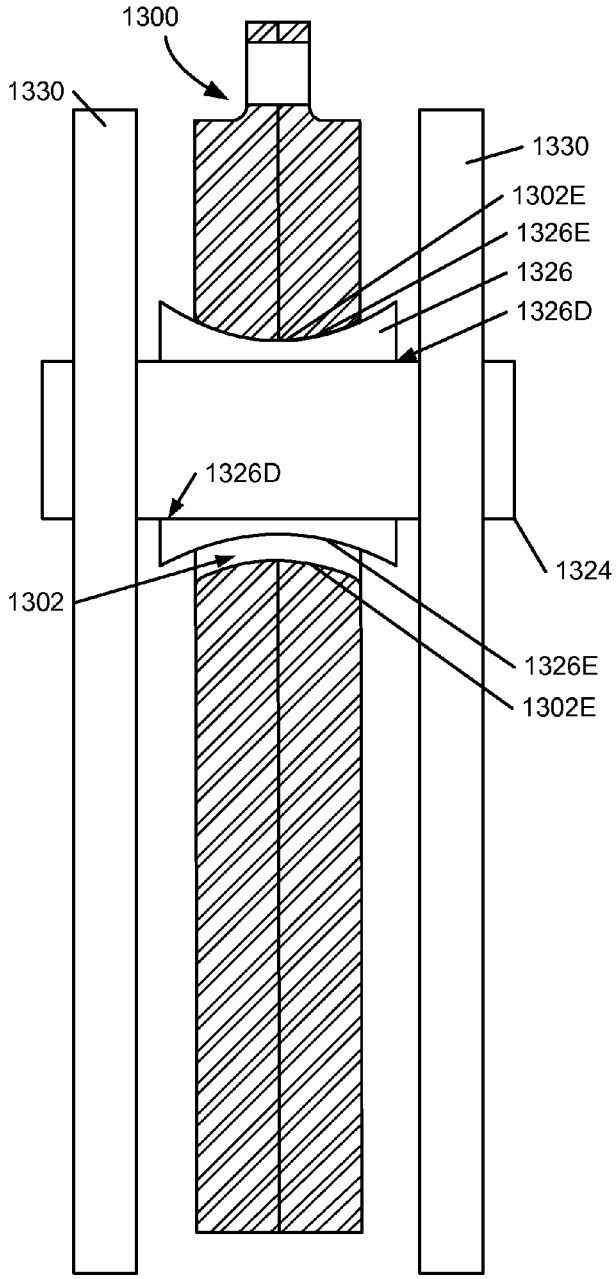

FIGS. 13A and 13B illustrate one example of the use of a separate pin engaging member for engaging a shredder hammer 1300 and pin 1324 as briefly described above. In this example, the shredder hammer 1300 may have a construction the same as or similar to one of the constructions above (e.g., those shown in FIGS. 5A-5C, 6, 7, 8, 10, and 11A-11C). In this example arrangement, however, the hammer pin 1324 includes a spool 1326 mounted thereon. The spool 1326 includes an interior opening 1326D for receiving the pin 1324, and the spool 1326 may be engaged with the pin 1324 in any desired manner without departing from this invention, including via welding, via mechanical connectors, etc. Alternatively, if desired, the pin 1324 may fit loosely within the spool opening 1326D, optionally with the spool 1326 being maintained in place by the divider plates 1330 of the shredder head (e.g., disks 120 for FIG. 1B). The spool 1326 may be made of any desired materials, including materials conventionally used for shredder hammer and/or hammer pin constructions.

The exterior surface 1326E of the spool 1326 may be curved from one side of the opening 1326D to the other side. The curved exterior surface 1326E may have any desired shape, including any of the shapes for the curved interior surfaces of the pin opening constructions described above with respect to FIGS. 5A through 11C. Optionally, if desired (and as illustrated in FIG. 13B), the curved exterior surface 1326E of the spool 1326 may bear against a similarly shaped interior surface 1302E of the mount opening 1302 of the shredder hammer 1300. The exterior surface 1326E of the spool 1326 may have a radius (or other curved construction) that is the same as or slightly larger than the radius (or other curved construction) of the corresponding bearing surface 1302E of the mount opening 1302 of the shredder hammer 1300, so that a smoothly rolling engagement between these surfaces may be accomplished. The interior surface of the spool 1326 (which receives the pin 1324) may be curved or flat and/or it may conform in shape to the exterior surface of the pin 1324.

The shredder hammer/pin construction of FIGS. 13A and 13B may be useful, in at least some environments, because the materials of the various parts (e.g., the pin 1324, the hammer 1300, and the spool 1326) may be selected so that the majority of the wear and tear is absorbed by the spool 1326, which may thereby lengthen the pin and/or hammer life. The curved bearing connection between the pin 1324 and the hammer 1300 (via the spool 1326) also may provide the various advantages described above for the constructions of FIGS. 5A through 11C.

Figure 14A:
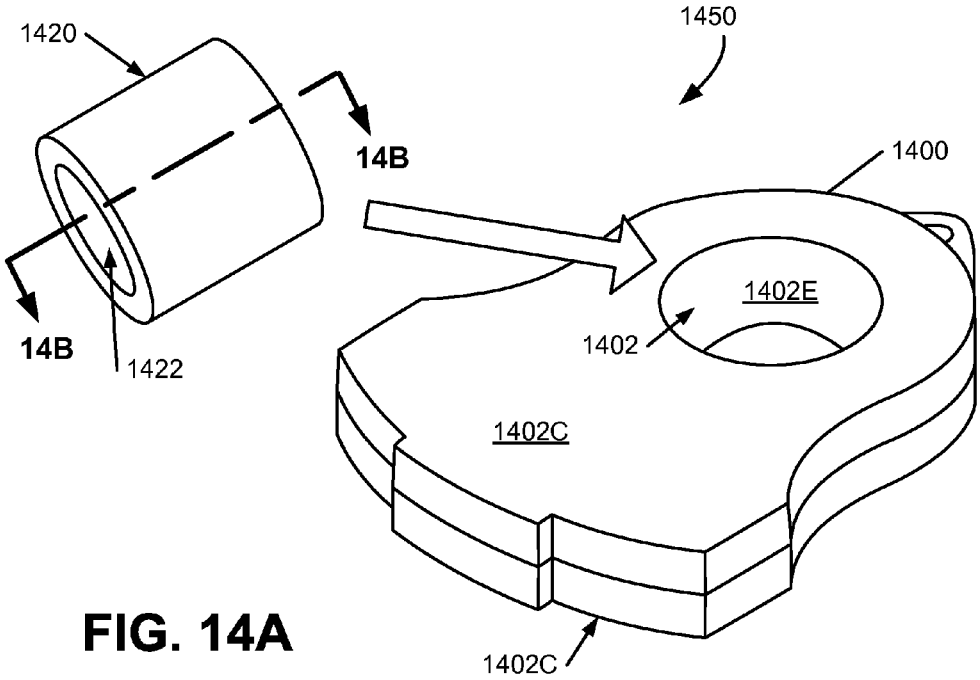
FIGS. 14A and 14B illustrate various views of another example shredder hammer structure in accordance with this invention.
Figure 14B:
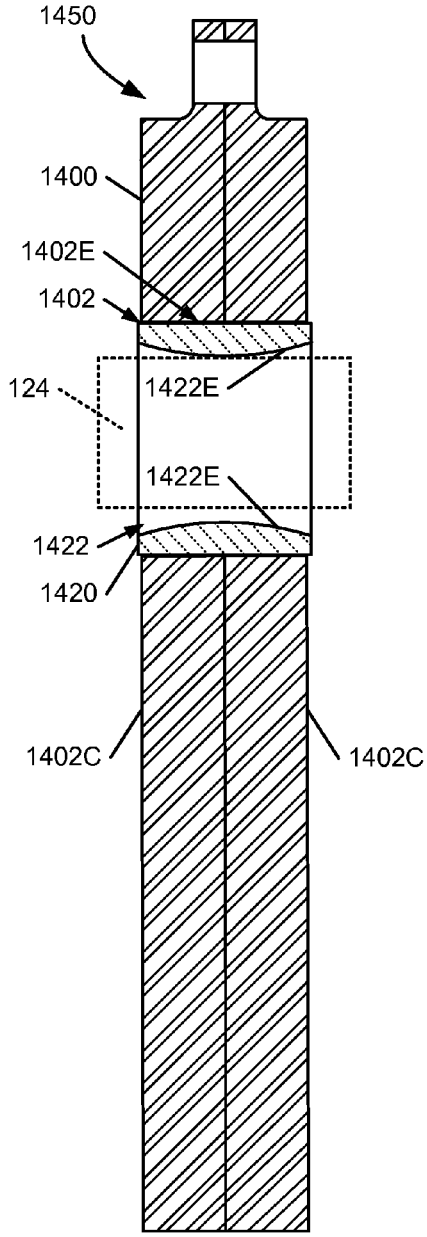

While all of the example structures described above have a curved interior pin-receiving opening (or mount opening) on the shredder hammer, this is not a requirement in all hammer pin/shredder hammer engagement arrangements in accordance with this invention. FIGS. 14A and 14B illustrate an example construction 1450 in accordance with this invention in which the mount opening 1402 of the shredder hammer 1400 may (but is not required to) have a relatively flat interior surface 1402E in the major surface to major surface direction (e.g., optionally of the types illustrated in FIGS. 2A and 2B). In this example arrangement 1450, a bushing member 1420 is provided within the mount opening 1402 of the shredder hammer 1400, and the interior surface 1422E of the bushing member 1420 may include a curved surface from one end of its pin receiving opening 1422 to the other end (e.g., curved in any of the various manners described above). A pin 124 is shown in FIG. 14B mounted in the pin receiving opening 1422 of the bushing member 1420. Thus, in this example of the invention, the bushing 1420 rather than the shredder hammer provides the curved pin bearing surface.

The bushing member 1420 may be engaged within the mount opening 1402 of the shredder hammer 1400 in any desired manner without departing from this invention. For example, if desired, the bushing member 1420 may be fixedly engaged with the shredder hammer 1400 by welding or other fusing techniques, by mechanical connectors, or the like. The bushing member 1420 may be made of any desired materials without departing from this invention, including any of the materials described above and/or conventionally used for shredder hammer construction.

The bushing member 1420 may take on a wide variety of shapes without departing from this invention. For example, while FIG. 14B shows the bushing member 1420 terminating substantially at the major surfaces 1402C of the shredder hammer 1400, this is not a requirement. Rather, if desired, the bushing member 1420 may include end caps or flanges that extend at least partially over and adjacent to one or more of the major surfaces 1402C of the shredder hammer 1400. The bushing 1420 also may be sized to have its end surfaces located within the edges of the hammer mount opening 1402. Other constructions also are possible without departing from this invention.

FIGS. 15A through 15E illustrate another example "bushing type" connection structure between a hammer pin and a shredder hammer. In this example structure, the bushing is in the form of a ball swivel member 1520 that engages with a mount opening 1502 of a shredder hammer 1500. The mount opening 1502 of the shredder hammer 1500 in this example structure includes an interior surface 1502E having a partial spherical shape (as will be described in more detail below) and a ball swivel insertion area 1504.

In this example arrangement, the ball swivel member 1520 has a generally exterior spherical surface 1520S except two opposing ends 1520E of the sphere are cut off and a hammer pin receiving opening 1522 is defined between these ends. The exterior spherical surface 1520S of the ball swivel member 1520 is generally sized and shaped to be received and held adjacent to the interior surface 1502E of the mount opening 1502 of the shredder hammer 1500. The interior surface 1520P of the ball swivel 1520, which directly bears against a hammer pin in use, may have a generally flat surface from one end 1520E of the pin receiving opening 1522 to the other end 1520E.

Figure 15A:
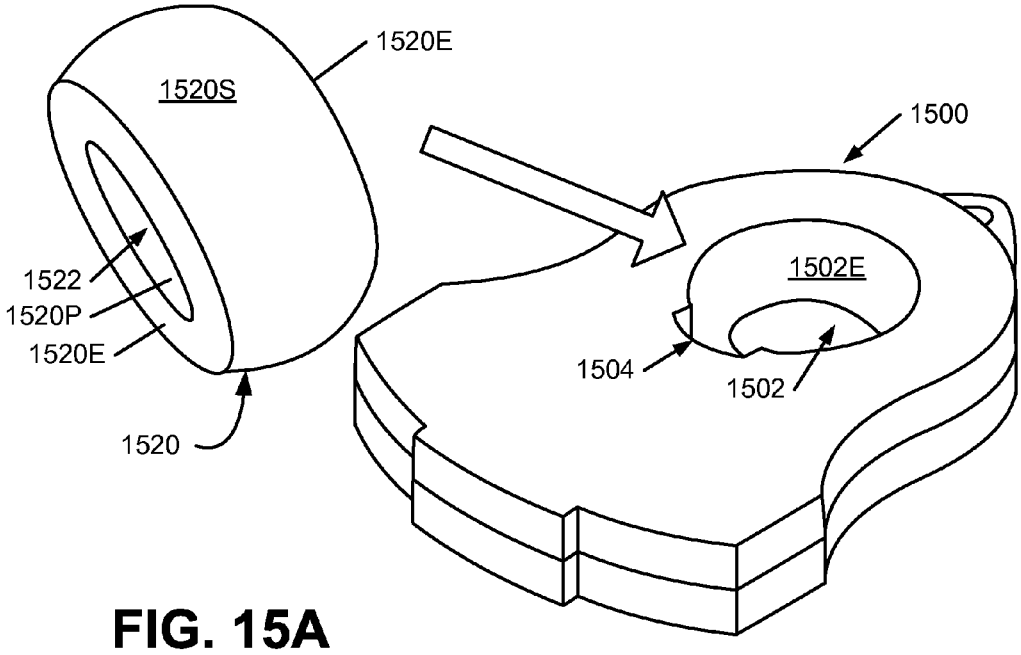
FIGS. 15A through 15E illustrate various views of yet another example shredder hammer structure in accordance with this invention.
Figure 15B:
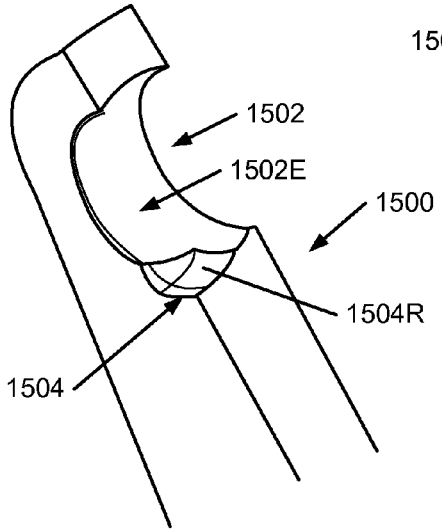
Figure 15C:
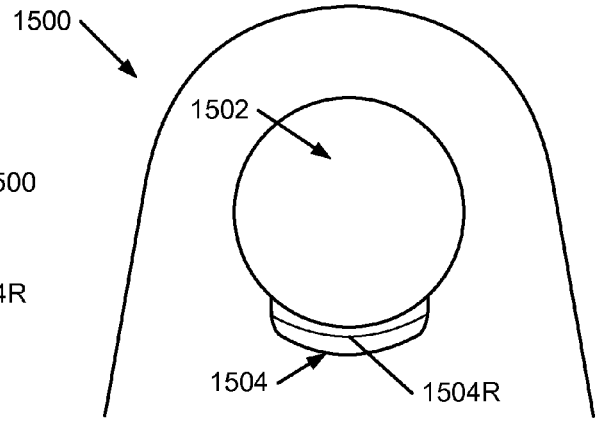
Figure 15D:
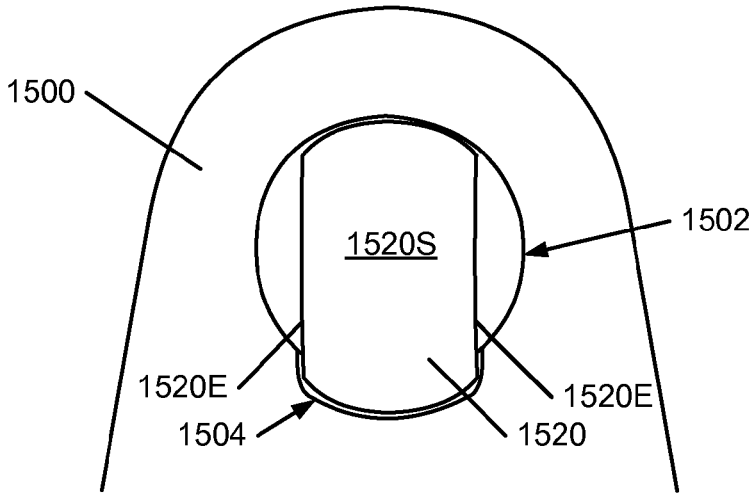
Figure 15E:
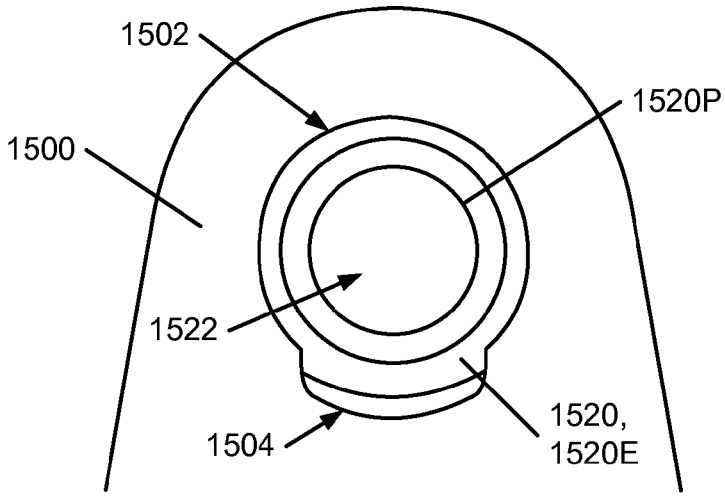

Mounting of the ball swivel 1520 in the shredder hammer 1500 in this example construction will now be described in conjunction with FIGS. 15D and 15E. As shown in FIG. 15D, first the ball swivel 1520 is turned so that its opposing ends 1520E are aligned with the edges of the ball swivel insertion area 1504 of the mount opening 1502. In this orientation, the ball swivel 1520 can be inserted into the mount opening 1502 and it moves up the ramped interior surface 1504R of the insertion area 1504. Once fully inserted (i.e., at the interior end of the ramped surface 1504R), the ball swivel 1520 may be twisted to the orientation shown in FIG. 15E so that the ball swivel pin receiving opening 1522 aligns with the mount opening 1502 of the shredder hammer 1500. The ball swivel 1520 is retained within the mount opening 1502 because its spherical exterior surface 1502E has a larger outer dimension than the diameter of the mount opening 1502. Once in place, the ball swivel 1520 will receive a hammer pin through the opening 1522, which holds the ball swivel 1520 within the mount opening 1502, as noted above, because the ball swivel 1520 cannot be rotated 90° (due to the presence of the hammer pin) and because the ball swivel's exterior surface 1520E is larger than the mount opening 1502. The hammer 1500 will then be capable of rotating on the ball swivel 1520 during use, including rotating within the opening 1522 when the shredder hammer 1500 hits a material to be shredded in an off-center manner (i.e., the ball swivel 1520 will allow some sideways rotation of the hammer 1500 as well as circumferential rotation).

Other spool and bushing constructions and arrangements may be used without departing from this invention. In such constructions, however, at least some interface surface between the various parts that connect the hammer pin to the shredder hammer will be curved, and optionally continuously curved from one end of the pin receiving opening to the other.

Figure 16A:
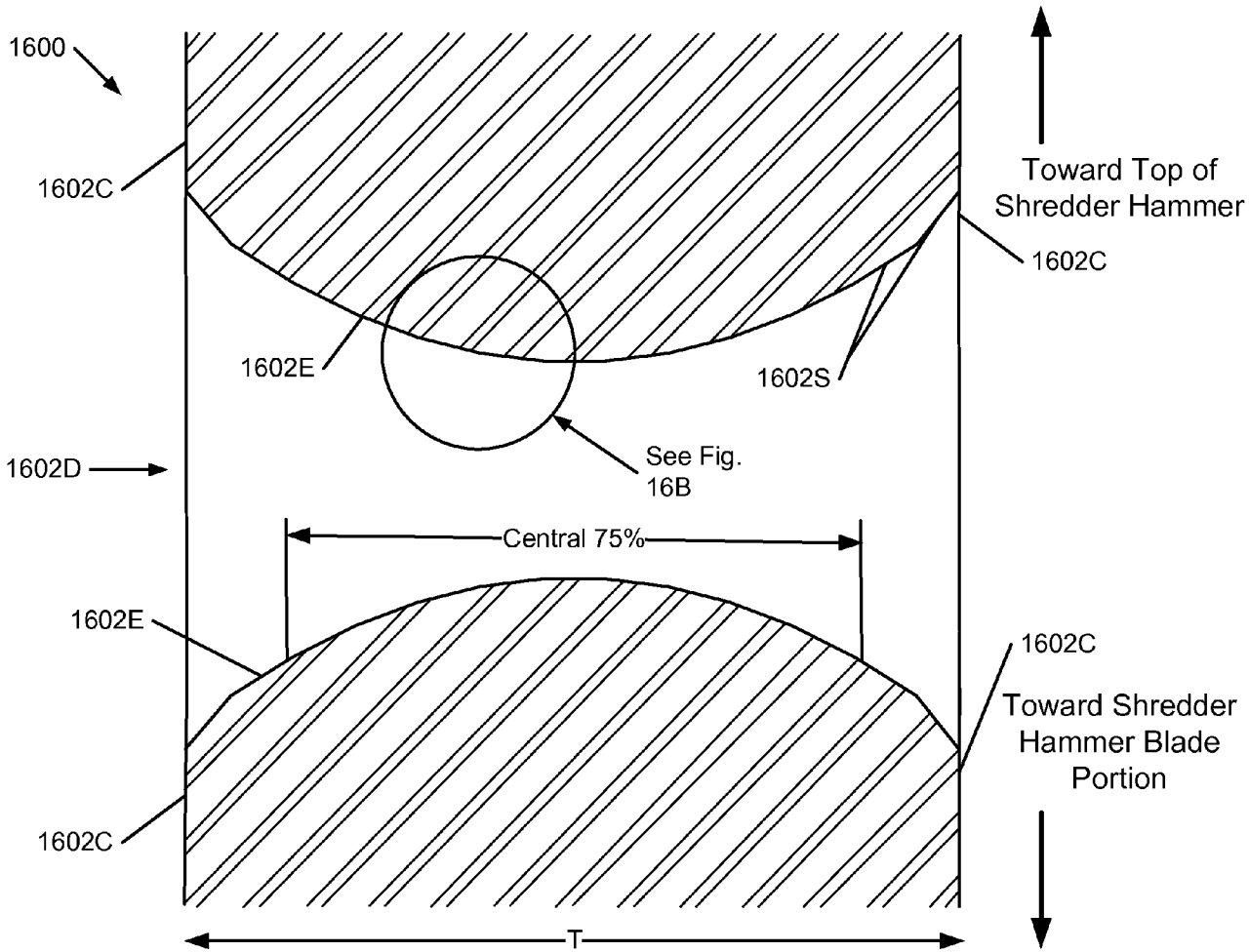
FIGS. 16A and 16B illustrate another example shredder hammer pin opening construction in accordance with this invention.
Figure 16B:
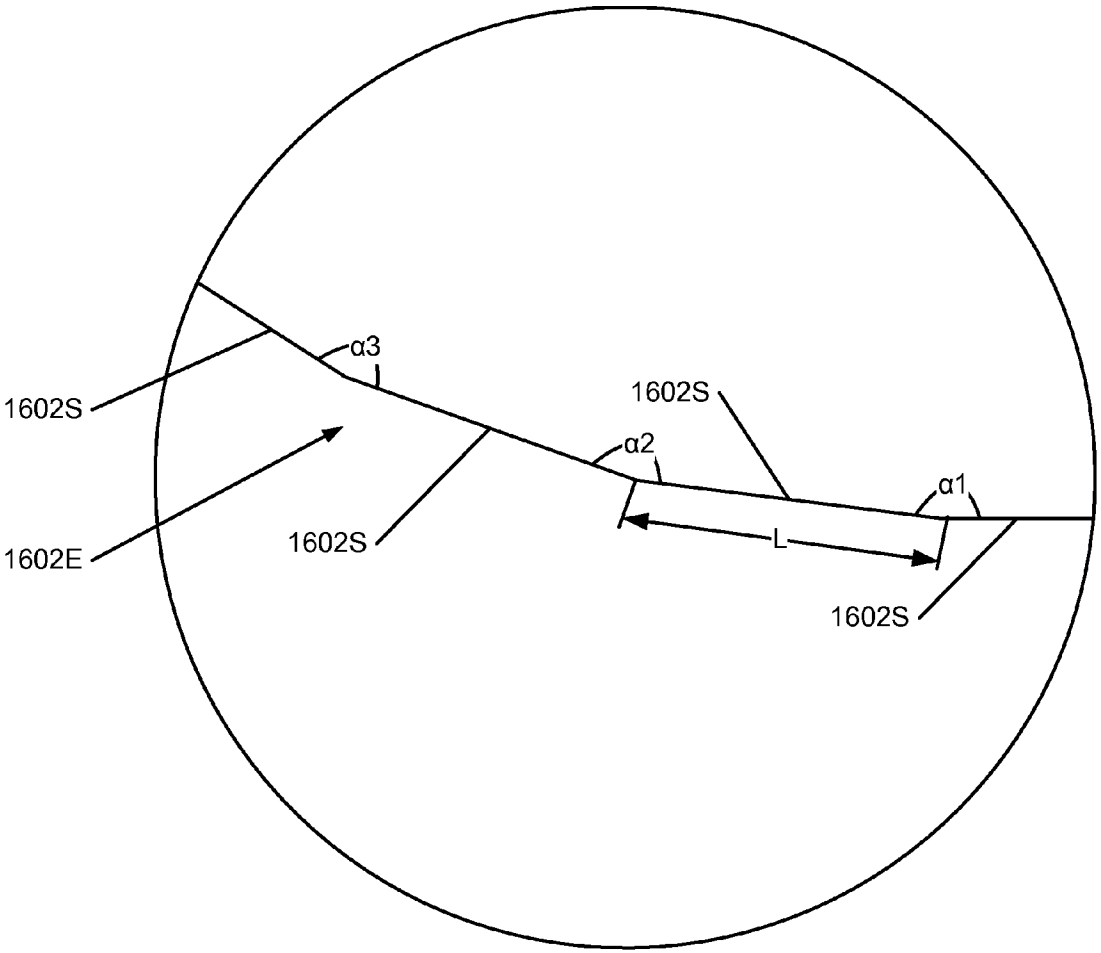

While several structures in accordance with examples of this invention include curved surfaces bearing the weight of the hammer on the hammer pin, curved surfaces are not a requirement in all structures according to this invention. FIGS. 16A and 16B illustrate an example hammer pin structure 1600 in accordance with this invention wherein the interior surface 1602E of the hammer pin opening 1602D, in cross section, includes a series of flat segments 1602S that are aligned from one major surface 1602C of the hammer body to the other major surface so as to approximate the curved surfaces described above. FIG. 16B constitutes an enlarged view of the circled area shown in the cross sectional view of FIG. 16A. The segment lengths L, the number of segments 1602S, and the angles $\alpha 1$, $\alpha 2$, $\alpha 3$, etc. between adjacent segments 1602S may take on any desired values without departing from this invention, and the specific ranges of suitable dimensions for the lengths L and angles $\alpha$ and the overall number of segments 1602S may be determined through routine experimentation. Moreover, the lengths L and angles $\alpha$ may be the same or different over the thickness of the hammer pin opening 1602D from one major surface 1602C to the other. At least some of the flat segments are located within the central 75% of the overall thickness of the shredder hammer.

As some more specific examples, the lengths L of the segments 1602S may be in the range of 0.01T to 0.5T (and in some examples between 0.05T and 0.33T or even between 0.075T and 0.2T), where T is the thickness of the shredder hammer 1600 at the location of the hammer pin receiving opening 1602D. The angles $\alpha$ may be obtuse angles. In some more specific examples, the angles $\alpha$ may range, for example, from 120° to 179°, and in some examples, within the range of 150° to 175°. The number of segments 1602S may range, for example, from 2 to 50, and in some examples, from 3 to 40 or from 5 to 30 without departing from this invention. In this example structure, as the number of segments 1620S get large, the lengths L of the segments 1620S gets small, and the angles between adjacent segments approaches 180°, the surface becomes (or essentially becomes) a smoothly curved surface.

If desired, in some example hammer pin opening constructions in accordance with this invention, the segmented "flats" feature described above may be used in combination with a curved surface as described in other examples above. For example, if desired, the very center of the hammer pin receiving opening (between the two major surfaces thereof) may include one or more flat segments while the edges of the opening (near the major surfaces) may be curved. Alternatively, if desired, a continuously curved structure may be provided at the center of the hammer pin receiving opening while the edges of the opening include the segmented construction. Other combinations of curved and segmented surface features may be used without departing from this invention.

Weight bearing surfaces including flat segments like those described above in conjunction with FIGS. 16A and 16B also may be used as the weight bearing surfaces (in place of or in combination with the curved surfaces) for the spool and/or bushing type embodiments of the invention described above. Also, weight bearing surfaces including flat segments like those described above in conjunction with FIGS. 16A and 16B also may be included in structures like those shown in FIGS. 8, 10, 12A, and 12B in which a top portion of the opening (as shown in these figures) has a different surface configuration than a bottom portion of the opening. In other words, the entire circumference of the opening need not have the same surface shape.

Figure 17A:
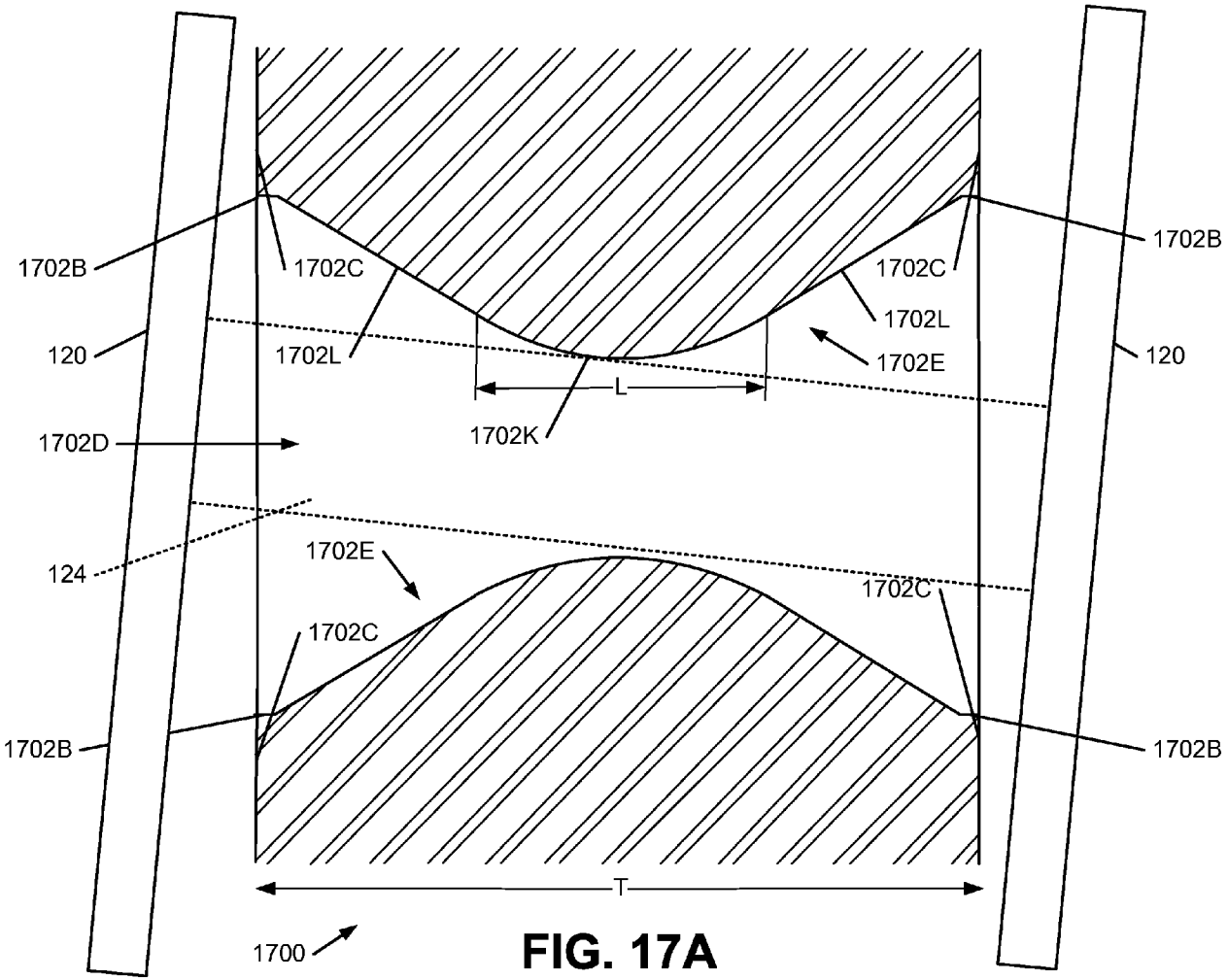
FIGS. 17A and 17B illustrate additional example shredder hammer pin opening constructions in accordance with this invention.

FIG. 17A illustrates another example shredder hammer construction in which a curved surface does not extend the entire thickness of the hammer pin receiving opening. As illustrated in FIG. 17A, in some shredder hammer structures 1700 in accordance with examples of this invention, only a central portion 1702K of the surface 1702E of the opening 1702D has the curvature to provide the advantages described above, while the sides 1702L and edges 1702B of the opening 1702D may have other curvature and/or edge features. As some more specific examples, the sides 1702L may constitute long linear or flat surfaces, and the edges 1702B may constitute tightly curved or beveled edge constructions, e.g., like those described above in conjunction with FIGS. 2A and 2B. Such side and edge features may be provided, for example, if the opening 1702D and pin 124 are sized such that the pin surface cannot reach the corner edges 1702B of the opening 1702D irrespective of the off center angle that the pin 124 makes with respect to the hammer 1700. As another example, the divider plates 120 (or other structures of the shredder head) may limit the sideways movement of the hammer 1700 on the pin 124. If the curvature of the hammer pin receiving opening 1702D is such that the divider plates 120 will stop the hammer's sideway movement before the hammer 1700 tilts enough so that the pin 124 reaches the corner edge 1702B of the opening 1702D, than the corner edge 1702B of the opening 1702D may have a squared off, beveled, tightly curved, or other desired construction.

In such structures, the proportion of the thickness of the opening 1702D that includes the curved surface 1702K (length L in FIG. 17A) may be any desired proportion of the overall thickness T of the hammer pin opening 1702D provided the desired advantages described above and below are achieved. In some more specific examples of this invention, the curved surface 1702K may extend at least 25% of the overall linear dimension of the hammer pin opening thickness (i.e., $L \geqq 0.25T$), and in some additional examples, the curved surface 1702K may extend at least 30%, at least 40%, or even at least 50% of the overall linear dimension of the hammer pin opening thickness. The curved surface 1702K provides a local extrema of the hammer pin opening surface 1702E within the interior of the opening, in the central portion between the major surfaces (optionally, within the central 75% of the hammer pin opening thickness). Moreover, while the curved surface 1702K may be centered in the overall thickness of the hammer pin opening 1702D as shown in FIG. 17A, it also may be located at any other desired position or location along the thickness T without departing from the invention. Likewise, the side surfaces (flat surfaces 1702L in this example structure 1700) may extend at the same or different angles with respect to the major surface 1702C without departing from this invention.

Figure 17B:
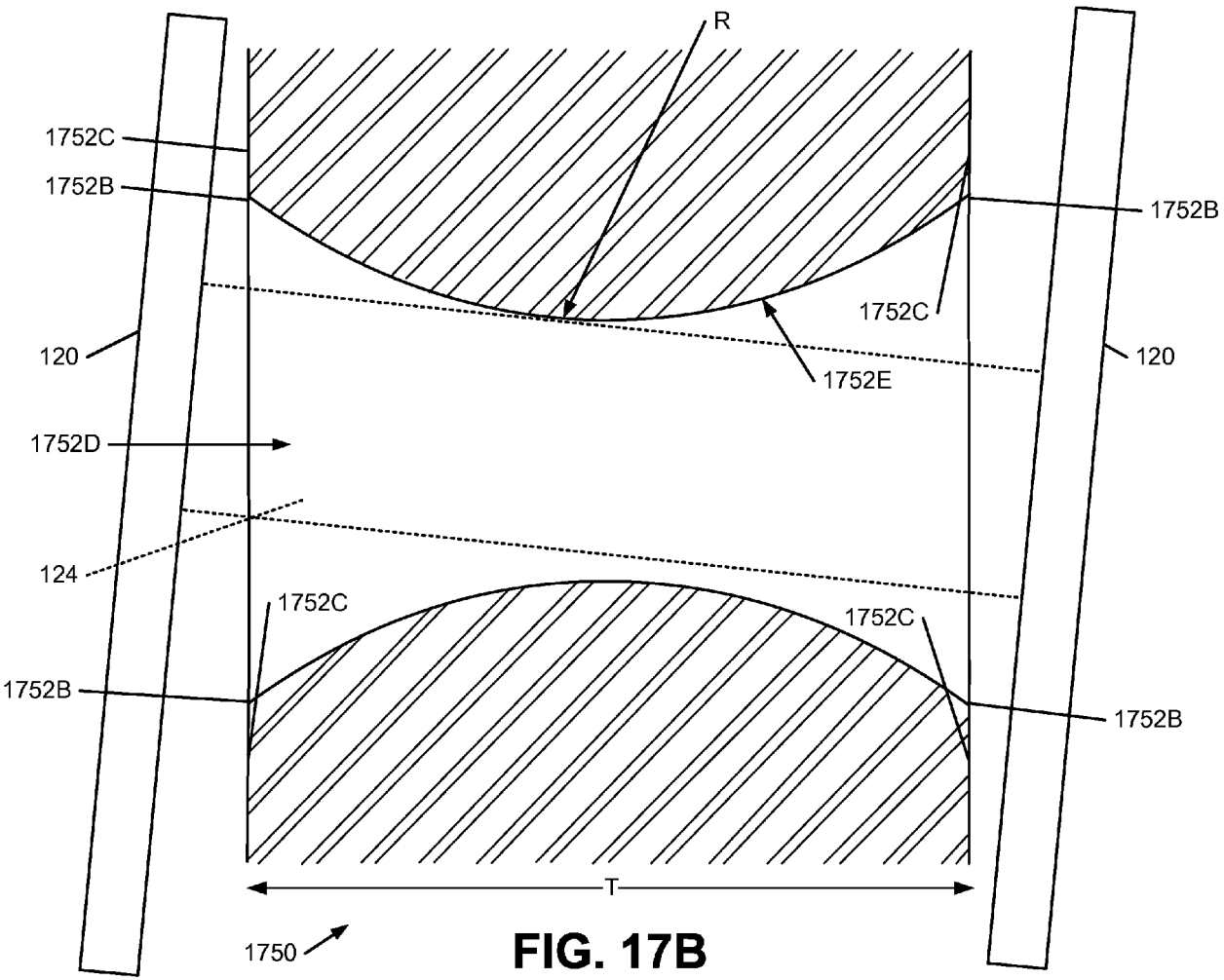

FIG. 17B illustrates an example hammer body structure 1750 in which the hammer pin opening 1752D has its interior surface 1752E defined (in cross section) by a single curve R that extends from one major surface 1752C of the hammer body 1750 to the other major surface 1752C. In this example hammer structure 1750, R is in the form of an arc of a circle having a radius greater than 0.5T (although other structures are possible, such as parabolic shaped, irregularly shaped curves, combinations of different curves, combinations of curves with flat surfaces, etc.). Due to the shape of the surface 1752E (with R greater than 0.5T in this example), the surface 1752E is not tangent with the outer major surfaces 1752C of the hammer body 1750 (rather, a more abrupt corner is provided). Nonetheless, due to the opening size 1752, the pin 124 diameter, and/or the placement of the divider plates 120 with respect to the hammer body 1750 (or other relevant factor(s)), the hammer body 1750 cannot swing sideways to the extent necessary to put stress at the corner edges 1752B where the interior hole surface 1752E meets the major surfaces 1752C of the hammer body 1750. Accordingly, this edge structure 1752B may have any desired shape or cross sectional appearance.

Weight bearing surfaces including structures like those described above in conjunction with FIGS. 17A and 17B also may be used as the weight bearing surfaces for the spool and/or bushing type embodiments of the invention described above. Also, weight bearing surfaces like those described above in conjunction with FIGS. 17A and 17B also may be included in structures like those shown in FIGS. 8, 10, 12A, and 12B in which a top portion of the opening (as shown in these figures) has a different surface configuration than a bottom portion of the opening. In other words, the entire circumference of the opening need not have the same surface shape.

As noted above, shredder hammers in accordance with this invention may have any desired sizes and shapes without departing from the invention, particularly exterior perimeter shapes, including sizes and shapes that are conventionally known and used in the art. As some more specific examples, the shredder hammer may have a total weight within the range of 100-1500 lbs, and in some examples, within the range of 150-1200 lbs. The shredder hammer may have an overall height H (from the tip of the lifting eye 210 to the end of hammer blade portion 202B) in a range from 15 to 50 inches (and in the illustrated example, about 37.5 inches), an overall width W in a range from 10 to 40 inches (and in the illustrated example, about 27 inches), and an overall thickness T in a range from 1 inch to 10 inches (and in the illustrated example, about 5.5 inches). In the illustrated example of FIGS. 5A through 5C, the interior surface 202E of the opening 202D has a central radius $R_1$ (e.g., between points B and C of FIG. 6) of about 5.4 inches, and each of the end portions (e.g., between points A and B and between points C and D of FIG.

6) has a radius of about 0.55 inches. The opening 202D is formed so that the overall curve 202E smoothly flows between the areas of changing radii.

While aspects of this invention may be practiced with any type of shredder hammer material, aspects of the invention may be particularly advantageous when used with shredder hammer materials that experience upsetting and/or hardening processes of the types described above. In some examples of this invention, the curved interior surface of a hammer pin opening in accordance with this invention will be used in conjunction with shredder hammers formed, at least in the area of the hammer pin opening, from materials susceptible to upsetting and/or hardening processes of the types described above. As yet even some more specific examples, the curved interior surface of a hammer pin opening in accordance with this invention will be used in conjunction with shredder hammers formed from hardened steel materials, such as low alloy steels or high manganese alloy content steels (e.g., 10-20% manganese) (such as Hadfield Manganese Steel or other steel containing about 11 to 14% manganese, by weight).

Some advantageous aspects of this invention relate to the improved service life and/or avoidance of premature failure of shredder hammers, particularly shredder hammers formed at least in part from materials that experience upsetting and/or hardening processes as described above. This improved life and reliability will reduce shredder down time, decrease costs (e.g., of parts, labor, etc.), and improve shredding production throughput. The advantageous reduction of stress at the pin opening edges in accordance with this invention may be useful irrespective of the material used for making the hammer (e.g., for hammers made from manganese alloy steels described above as well as hammers made from other materials that do not necessarily exhibit the upsetting properties described above, including hammers made from conventional materials as are known and used in the art).

Moreover, the inclusion of the curved interior surface of a hammer pin opening in shredder hammers in accordance with at least some examples of this invention may simplify the hammer production method. Because of their structure (e.g., with straight side walls 112B in the opening 112A), the openings in conventional shredder hammer structures often are produced using cores and sand casting or sand molded casting methods. Setting up the mold and including cores for the opening structure increases the set-up time and costs associated with the casting process. The curved shredder hammer pin opening (e.g., 202D) according to at least some embodiments of this invention does not require cores for its formation. This is because the curved surface shape (e.g., surface 202E) has adequate "draft" to allow the mold halves to directly form the desired opening (e.g., 202D) and to be pulled apart or removed when the casting process is completed. This feature can make shredder hammers in accordance with at least some examples of this invention easier, cheaper, and faster to manufacture than shredder hammer structures including more conventional hammer pin openings. Moreover, this feature can improve solidification and quenching as the water can get into and out of the opening (e.g., 202D) more easily, which helps provide a better quench in this key area. These advantageous features and aspects of the invention may be realized irrespective of the material used for making the hammer (e.g., for hammers made from manganese alloy steels described above as well as hammers made from other materials that do not necessarily exhibit the upsetting properties described above, including hammers made from conventional materials as are known and used in the art).

CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the example structures described above without departing from the scope of the present invention.

We claim:

1. A shredder hammer, comprising:

a hammer body including a hammer mounting portion and a hammer blade portion, wherein the hammer mounting portion includes a mount opening defined therein that extends from a first major surface of the hammer body to a second major surface of the hammer body, wherein a pin mounting surface is provided within the mount opening for engaging a hammer pin, wherein at least a portion of the pin mounting surface is convex, and wherein at least some of the portion of the pin mounting surface that is convex is continually curved throughout an overall thickness of the hammer body between the first and second major surfaces at the mount opening and is located at least along a half of the hammer pin receiving opening located farthest away from the hammer blade portion.

2. A shredder hammer according to claim 1, wherein the pin mounting surface is formed directly in an interior surface of the mount opening of the hammer body.

3. A shredder hammer according to claim 2, further comprising:

a spool member at least partially received within the mount opening, wherein the spool member includes a hammer pin mounting opening defined therethrough and an exterior surface that engages the interior surface of the mount opening.

4. A shredder hammer according to claim 3, wherein at least a portion of the exterior surface of the spool member that engages the interior surface of the mount opening is continually curved in a longitudinal direction of the spool member.

5. A shredder hammer according to claim 1, further comprising:

a bushing member received in the mount opening, wherein an interior surface of the bushing member constitutes the pin mounting surface.

6. A shredder hammer according to claim 5, wherein at least a portion of the pin mounting surface is continually curved from a first end of the bushing member to a second end of the bushing member.

7. A shredder hammer according to claim 5, wherein the bushing member is fixedly engaged with the hammer body at least partially within the mount opening.

8. A shredder hammer according to claim 1, wherein the convex portion of the pin mounting surface is completely located in a half of the hammer pin receiving opening located farthest away from the hammer blade portion.

9. A shredder hammer according to claim 1, wherein at least a portion of the pin mounting surface located within a half of the mount opening located nearest to the hammer blade portion is not continually curved in the direction from the first major surface to the second major surface.

10. A shredder hammer according to claim 1, wherein the convex portion of the pin mounting surface includes a first region having a cross section of an arc of a circle, wherein the circle has a radius $R_1$ corresponding to the formula $0.5 \leqq R_1/T \leqq 4$, wherein T is a smallest thickness dimension of the shredder hammer at the mount opening.

11. A shredder hammer according to claim 1, wherein the convex portion of the pin mounting surface includes: (a) a central region having a cross section of an arc of a first circle, wherein the first circle has a radius $R_1$ corresponding to the formula $0.5 \leqq R_1/T \leqq 4$, wherein T is a smallest thickness dimension of the shredder hammer at the mount opening, (b) a first end region at a first end of the central region, the first end region having a cross section of an arc of a second circle having a radius $R_2$, wherein $R_2$ is in the range of $0.05R_1$ to $0.5R_1$, and (c) a second end region at a second end of the central region, the second end region having a cross section of an arc of a third circle having a radius $R_3$, wherein $R_3$ is in the range of $0.05R_1$ to $0.5R_1$, and wherein $R_3$ may be the same as or different from $R_2$.

12. A shredder hammer according to claim 11, wherein $R_3$ is the same as $R_2$.

13. A shredder hammer according to claim 1, wherein the convex portion of the pin mounting surface includes a local extrema located within a central 30% of the overall thickness of the hammer body at the mount opening.

14. A shredder hammer according to claim 1, wherein the convex portion of the pin mounting surface includes a local extrema located at a center of the overall thickness of the hammer body at the mount opening.

15. A shredder hammer according to claim 1, wherein the convex portion of the pin mounting surface is located at a position corresponding to a primary load bearing portion of the pin mounting surface when the shredder hammer is rotated on a rotary shredding head.

16. A shredder hammer according to claim 1, wherein the convex portion of the pin mounting surface is continually curved in a direction from the first major surface toward the second major surface, and wherein the pin mounting surface includes a portion that is not continually curved in the direction from the first major surface to the second major surface.

17. A shredder hammer according to claim 1, wherein the hammer body is constructed, as least in part, from a steel material that experiences upsetting in response to repeated impact forces.

18. A shredder hammer according to claim 1, wherein the hammer body is constructed, as least in part, from a steel material having a manganese alloy content in a range from 10-20% by weight.

19. A shredder hammer according to claim 1, wherein the hammer body is constructed, as least in part, from a steel material having a manganese alloy content of 11 to 14% by weight.

20. A shredder hammer according to claim 1, wherein the hammer body is constructed, as least in part, from Hadfield manganese steel.

21. A shredder hammer, comprising:

a hammer body including a hammer mounting portion and a hammer blade portion, wherein the hammer mounting portion includes a mount opening defined therein that extends from a first major surface of the hammer body to a second major surface of the hammer body, wherein a pin mounting surface is provided within the mount opening for engaging a hammer pin, wherein at least a portion of the pin mounting surface is convex, wherein at least some of the portion of the pin mounting surface that is convex is located within a central 90% of an overall thickness of the hammer body between the first and second major surfaces at the mount opening, and wherein the convex portion of the pin mounting surface includes a plurality of flat, non-parallel surfaces, wherein each flat surface within a central 50% of the overall thickness of the hammer body at the mount opening is joined to its adjacent flat surface at an obtuse angle.

22. A shredder hammer according to claim 21, wherein the convex portion of the pin mounting surface includes from 3 to 40 flat, non-parallel surfaces.

23. A shredder hammer, comprising:

a hammer body including a hammer mounting portion and a hammer blade portion, wherein the hammer mounting portion includes a mount opening defined therein that extends from a first major surface of the hammer body to a second major surface of the hammer body; and a pin engaging member received in the mount opening, wherein the pin engaging member includes an exterior surface that engages the mount opening, and wherein the pin engaging member defines a hammer pin receiving opening including an interior surface for receiving a pin, wherein the pin engaging member includes a ball swivel, wherein the ball swivel is rotatable within the mount opening of the hammer body.

24. A shredder hammer according to claim 21, wherein at least some of the portion of the pin mounting surface that is convex is located at least along a half of the hammer pin receiving opening located farthest away from the hammer blade portion.

* * * * *